US007390604B2

(12) United States Patent
Miyakawa et al.

(10) Patent No.: US 7,390,604 B2
(45) Date of Patent: Jun. 24, 2008

(54) NEGATIVELY CHARGEABLE SPHERICAL TONER, COLOR IMAGE FORMING APPARATUS, AND PROCESS FOR PRODUCING NEGATIVELY CHARGEABLE SPHERICAL TONER

(75) Inventors: Nobuhiro Miyakawa, Nagano (JP); Toshiaki Yamagami, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 198 days.

(21) Appl. No.: 11/336,425

(22) Filed: Jan. 20, 2006

(65) Prior Publication Data

US 2006/0177754 A1 Aug. 10, 2006

(30) Foreign Application Priority Data

Jan. 21, 2005 (JP) ..... P.2005-014029
Jan. 21, 2005 (JP) ..... P.2005-014030

(51) Int. Cl.
*G03G 9/00* (2006.01)

(52) U.S. Cl. ..... 430/108.3; 430/108.6; 430/111.4; 430/111.41; 430/137.21; 399/252

(58) Field of Classification Search ..... 430/108.3, 430/108.6, 111.4, 111.41, 137.21; 399/252
See application file for complete search history.

(56) References Cited

U.S. PATENT DOCUMENTS

2003/0095814 A1* 5/2003 Miyakawa et al. ..... 399/252

FOREIGN PATENT DOCUMENTS

| | | |
|---|---|---|
| JP | 63-289559 | 11/1988 |
| JP | 06-332236 | 12/1994 |
| JP | 08-069123 | 3/1996 |
| JP | 08-173783 | 7/1996 |
| JP | 11-174726 | 7/1999 |
| JP | 11-184144 | 7/1999 |
| JP | 2001-117267 | 4/2001 |
| JP | 2002-189309 | 7/2002 |
| JP | 2002-207314 | 7/2002 |
| JP | 2002-236386 | 8/2002 |
| JP | 2002-258522 | 9/2002 |
| JP | 2002-268277 | 9/2002 |
| JP | 2002-318467 | 10/2002 |
| JP | 2003-202696 | 7/2003 |
| JP | 2003-207942 | 7/2003 |
| JP | 2003-280240 | 10/2003 |
| JP | 2003-280253 | 10/2003 |
| JP | 2003-295503 | 10/2003 |
| JP | 2003-322998 | 11/2003 |
| JP | 2004-184719 | 7/2004 |

* cited by examiner

*Primary Examiner*—Mark A Chapman
(74) *Attorney, Agent, or Firm*—Hogan & Hartson LLP

(57) ABSTRACT

The present invention provides a negatively chargeable spherical toner having: a toner mother particle having a binder resin and a colorant, which has: a number average particle size of from 4.5 to 9 μm; a particle size distribution that has an integrated value of particle sizes of 3 μm or less of 1% or less; and an average sphericity of from 0.95 to 0.99; and an alumina fine particle externally added to the toner mother particle, which has a number average particle size of from 0.1 to 1.0 μm, wherein a work function ($\Phi_t$) of the toner mother particle is larger than a work function ($\Phi_A$) of the alumina fine particle by at least 0.4 eV.

16 Claims, 9 Drawing Sheets

NEGATIVELY CHARGEABLE SPHERICAL TONER, COLOR IMAGE FORMING APPARATUS, AND PROCESS FOR PRODUCING NEGATIVELY CHARGEABLE SPHERICAL TONER

The present application is based on Japanese Patent Application Nos. 2005-014029 and 2005-014030 both filed on Jan. 21, 2005, and the contents thereof are incorporated herein by reference.

BACKGROUND

1. Technical Field

The present invention relates to a negatively chargeable spherical toner used in electrophotography, and a color image forming apparatus, and a process for producing a negatively chargeable spherical toner.

2. Related Art

In the electrophotography, after an electrostatic latent image formed on a latent image carrier provided with a photoconductive material is developed by using a toner containing a colorant, transferred to an intermediate transfer medium, further transferred to a recording material such as paper and then fixed by heat, pressure or the like, to form a copied material of a printed material. In such case as utilizing the latent image carrier, for example, in Reference 1, it is described that, in the toner mother particles, using an alumina fine particle as an external additive particle, holding the surface of a latent image carrier clean all the time by an abrasive action against the surface of a latent image carrier and by such procedure, such problems as fogging and scattering of the toner are tried to be prevented and a stable image can be formed and further, an alumina fine particle having a large diameter of from 0.1 to 1.0 μm is preferably defined as the alumina fine particle. However, since the alumina fine particle having a large diameter tends to have a smaller adhesive force to the toner mother particle than that of the alumina having a small diameter from a relation of a mass thereof, there is a problem that it is liable to be dropped off. Particularly, the alumina fine particle is high in hardness and when the amount of the alumina fine particle freed from the toner mother particle is large, there is a problem that various members of the apparatus are abraded. Further, when such amount of the alumina fine particle freed is large, it gives an influence on the powder characteristics or the electrostatic properties and particularly, when a continuous printing is performed, a behavior of the toner is changed in a discontinuous manner, and accordingly there is a problem that an image quality such as image density or color reproducibility to be obtained becomes uneven, particularly, in a full-color image. Further, when the toner in which the alumina fine particle having a large particle size becomes an external additive is tried to be applied to a non-contact developing method, in the case in which the amount of the alumina fine particle having a large particle size freed from the toner mother particle is large, it has been found that various types of problems are generated such that a scattering property is deteriorated and stability of the printed image is reduced and the like.

Further, as for a conventional technique regarding the external additive, externally adding three types of external additives having different particle sizes from one another to the toner mother particle is described in, for example, Reference 2 and JP 11-184144 A; externally adding an external additive having a large particle size and a charged polarity reverse to that of the toner mother particle or an abrasive is described in Reference 3 or JP 2003-322998 A; and externally adding an inorganic fine particle having a large particle size is described in Reference 4. In any of such cases as described above, when a long-term continuous printing is performed, the external additive is freed from the surface of the toner and then the freed external additive adheres to the surface of the image carrier or the surface of the intermediate transfer medium to cause a problem of the increase in the fogging or reversal transferred toner or a problem of resulting in the decrease in transfer efficiency. This phenomenon is that the freed external additive having a reverse polarity or a negatively chargeable toner left from being transferred firmly adheres on the latent image carrier and is not transferred to the intermediate transfer medium and further, there is a problem that the freed external additive promotes abrasion of the surface of the developing member. For example, as far as a non-magnetic monocomponent developing roller is concerned, convex and concave (Rz) thereof becomes small, to cause a change of the amount of the toner to be transported.

Then, as for the documents for restricting the amount of the external additive to be freed, those as described in, for example, Reference 5, and JP 2002-189309 A, JP 2002-207314 A, JP 2002-236386 A, JP 2002-258522 A, JP 2003-207942 A, JP 2003-280240 A, JP 2003-280253 A and JP 2004-184719 A are known. Any one of them enhances a cleaning performance, prevents abrasion of the latent image carrier, improves an image quality or enhances flowability or prevents filming or abrasion, but does not positively prevent the external additive having a large particle size from being freed from the surface of the toner mother particle and as a result, there still exist disadvantages in, for example, stabilizing property of the printed image, prevention of various types of filming and abrasion, and enhancement of charge stability of the toner.

Further, the definition of the work function of the toner or the external additive and trying for improving the image quality or stabilizing the charge properties are described in, for example, Reference 6, and JP 11-174726 A and JP 2003-202696 A, and still further, an attempt to realize a stabilized charge properties or to enhance the transfer efficiency by defining the work function of the external additive is described in Reference 7. In any of such cases as described above, after a continuous printing of several ten thousands of pages is performed, the initial toner properties can not be maintained and further, it is insufficient for providing a stabilized color image by preventing filming and abrasion.

Further, as shown in FIG. 9, the Henschel mixer has a mixing processing tank 101 in the cylinder shape and a stirring blade rotating with a high speed on the bottom of the mixing processing tank, and promotes the mixing by repetition of the upward and downward motion such that the material to be treated is transferred with a centrifugal force generated by the lower blade 105 rotating with a high speed on the bottom of the mixing processing tank to the wall of the processing tank, and the material to be treated is slipped down on the inclined surface formed by the deposition of the material to be treated itself by gravity when the influence of the upward force by the centrifugal force, and then is again upwardly moved with the centrifugal force generated by the blade rotating with a high speed. Further, it may be conceived that the stirring and dispersion may be promoted by rotating the upper blade 110 while the material to be treated is slipped down on the inclined surface by the deposition of the material to be treated itself. However, in such the Henschel mixer, the inclined surface formed by the deposition of the material to be treated itself is slipped won as it is by gravity, and thus rotation rarely occurs. Thus, this easily causes the same parts between the particles to be brought into contact, thus there being a problem that a desired dispersed adherence, that is, a homogeneous adherence is hardly achieved.

Meanwhile, it is known that a mixing processing tank in the spherical shape is used instead of the above Henschel mixer (References 8 and 9), which has a problem that when a toner mother particle having a high degree of circularity is employed in order to increase the transfer efficiency, the rotational property is excellent, however the surface area thereof is relatively small as compared with the irregular shaped toner, as well as the convex and concave of the surface is low, thus resulting in the increase in the amount of the external additive to be freed, which is problematic.

References as cited herein are as follows:

Reference 1: JP 8-69123 A
Reference 2: JP 63-289559 A
Reference 3: JP 2002-318467 A
Reference 4: JP 2003-322998 A
Reference 5: JP 2001-117267 A
Reference 6: JP 6-332236 A
Reference 7: JP 2003-295503 A
Reference 8: JP 8-173783 A
Reference 9: JP 2002-268277 A

SUMMARY

An advantage of some aspects of the present invention is to provide a negatively chargeable spherical toner capable of providing a stable color image free from deterioration of an image quality even after a continuous printing and particularly, appropriate for being applied in a non-contact developing method after being externally added with an alumina fine particle having a large particle size as a spacer particle and a color image forming apparatus using the toner.

Other advantage of some aspects of the invention is to provide a process for producing a negatively chargeable spherical toner which is capable of uniformly and firmly adhering an alumina fine particle having a large particle size of 0.1 to 1.0 μm to a toner mother particle, has a low amount of an external additive to be freed, excels in durability and transportability, does not leave a scratch on the surface of the developing roller or the latent image carrier, and does not give any influence on the image.

Furthermore, other advantages and effects of some aspects of the invention will become apparent from the following description.

The present invention is mainly directed to the following items:

1. A negatively chargeable spherical toner comprising: a toner mother particle comprising a binder resin and a colorant, which has: a number average particle size of from 4.5 to 9 μm; a particle size distribution that has an integrated value of particle sizes of 3 μm or less of 1% or less; and an average sphericity of from 0.95 to 0.99; and an alumina fine particle externally added to the toner mother particle, which has a number average particle size of from 0.1 to 1.0 μm, wherein a work function ($\Phi_t$) of the toner mother particle is larger than a work function ($\Phi_A$) of the alumina fine particle by at least 0.4 eV.
2. The negatively chargeable spherical toner according to item 1, wherein the work function ($\Phi_t$) of the toner mother particle is from. 5.2 to 5.8 eV; and the work function ($\Phi_A$) of the alumina fine particle is from 4.8 to 5.3 eV.
3. The negatively chargeable spherical toner according to item 1, wherein the alumina fine particle is an α-type alumina fine particle.
4. The negatively chargeable spherical toner according to item 1, wherein the toner mother particle is obtained by a solution suspension method.
5. The negatively chargeable spherical toner according to item 1, wherein the toner mother particle has the colorant on a surface of the toner mother particle.
6. The negatively chargeable spherical toner according to item 1, which is a full-color toner.
7. A color image forming apparatus comprising: negatively chargeable spherical toners; a latent image carrier; a plurality of developing units each for developing an electrostatic latent image by using the negatively chargeable spherical toners so as to form toner images sequentially on the latent image carrier; an intermediate transfer medium to which the toner images are transferred sequentially so as to form a color toner image; and a recording material to which the color toner image is transferred and fixed, wherein each of the negatively chargeable spherical toners comprises: a toner mother particle comprising a binder resin and a colorant, which has: a number average particle size of from 4.5 to 9 μm; a particle size distribution that has an integrated value of particle sizes of 3 μm or less of 1% or less; and an average sphericity of from 0.95 to 0.99; and an alumina fine particle externally added to the toner mother particle, which has a number average particle size of from 0.1 to 1.0 μm, wherein a work function ($\Phi_t$) of the toner mother particle is larger than a work function ($\Phi_A$) of the alumina fine particle by at least 0.4 eV.
8. The color image forming apparatus according to item 7, wherein the developing units each develops the electrostatic latent image by a non-contact developing method.
9. The color image forming apparatus according to item 7, wherein the developing units each develops the electrostatic latent image by a 4-cycle type rotary developing method.
10. The color image forming apparatus according to item 7, wherein the developing units each develops the electrostatic latent image by a tandem type developing method.
11. A process for producing a negatively chargeable spherical toner, which comprises: externally adding an alumina fine particle having a number average particle size of from 0.1 to 1.0 μm to a toner mother particle comprising a binder resin and a colorant, which has: a number average particle size of from 4.5 to 9 μm; a particle size distribution that has an integrated value of particle sizes of 3 μm or less of 1% or less; and an average sphericity of from 0.95 to 0.99 in a spherical mixing processing tank, wherein a work function ($\Phi_t$) of the toner mother particle is larger than a work function ($\Phi_A$) of the alumina fine particle by at least 0.4 eV, wherein the spherical mixing processing tank has: a bottom having a horizontal disc-shape; a rotary driving shaft vertically penetrating the center of the bottom; a stirring blade which upwardly discharges materials including the alumina fine-particle and the toner mother particle so that the materials are treated spirally along an inner wall of the spherical mixing processing tank; and a cylinder-shaped member vertically penetrating a top of the spherical mixing processing tank, which is on an extension of the rotary driving shaft and is arranged so that an edge thereof is located within the spherical mixing processing tank, wherein the materials which is upwardly discharged are transferred to the top of the spherical mixing processing tank spirally by a rotation of the stirring blade, and are lowered the kinetic energy thereof, and are resupplied to the stirring blade.

12. The process for producing a negatively chargeable spherical toner according to item 11, wherein the work function ($\Phi_t$) of the toner mother particle is from 5.2 to 5.8 eV; and the work function ($\Phi_A$) of the alumina fine particle is from 4.8 to 5.3 eV.
13. The process for producing a negatively chargeable spherical toner according to item 11, wherein the toner mother particle is obtained by a solution suspension method.
14. The process for producing a negatively chargeable spherical toner according to item 11, wherein the toner mother particle has the colorant on a surface of the toner mother particle.
15. The process for producing a negatively chargeable spherical toner according to item 11, which further comprising externally adding at least one of a hydrophobilized silica and a hydrophobilized titania.

16. The process for producing a negatively chargeable spherical toner according to item 15, which further comprising externally adding, after externally adding at least one of a hydrophobilized silica and a hydrophobilized titania, a metal soap particle and a fine particle having a polarity reverse to that of the toner mother particle.

BRIEF DESCRIPTION OF THE DRAWINGS

FIGS. 1A and 15 is a diagram illustrating a measurement cell to be used for measuring the work function of a toner. FIG. 1A is a front view and FIG. 1B is a side view of the measurement cell.

FIG. 2A is a perspective view illustrating the shape of a test specimen, and FIG. 2B is a diagram illustrating the testing state.

DESCRIPTION OF EXEMPLARY EMBODIMENTS

Figure 1A:
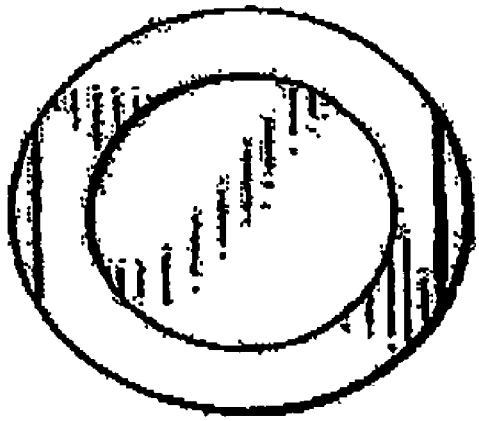

In the toner externally added with the alumina fine particle having the large particle size, there is a problem that, the alumina fine particle having the large particle size is freed, and a stable color image quality can not be obtained after a long-term continuous printing. When it is applied to a non-contact development method, particularly a non-magnetic monocomponent non-contact development method, the scattering property of the toner is deteriorated and such deterioration becomes a hindrance for obtaining a stable color image, and therefore it is important to decrease the amount of the alumina fine particle having the large particle size to be freed. The present inventors have found that, by allowing the work function ($\Phi_t$) of the toner mother particle to be larger than the work function ($\Phi_A$) of the alumina fine particle having the large particle size, namely, by setting a relation of $\Phi_t > \Phi_A$, particularly, $\Phi_t - \Phi_A > 0.4$ (eV), a negatively chargeable spherical toner which has a small amount of the alumina fine particles freed from the toner mother particles in the long-term continuous printing can be obtained.

In the present invention, the alumina fine particle has a number average particle size of from 0.1 to 1.0 μm.

The negatively chargeable spherical toner according to the invention can be formed by externally adding the external additive to the toner mother particle. The toner mother particle can be produced by any one of a pulverization method, a polymerization method and the solution suspension method.

As for a method by means of the pulverization method, a binder resin is allowed to contain at least a pigment, added with a release agent, a charge control agent and the like, and then uniformly mixed by using a Henschel mixer or the like and subsequently, melt-extruded by a twin screw extruder, cooled, subjected to a rough pulverizing step to a fine pulverizing step and classified, to prepare a toner mother particle.

As for the binder resins, homopolymers or copolymers containing styrene or styrene substituents of styrene resins such as polystyrene, poly-α-methyl styrene, chloropolystyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate ester copolymer, styrene-methacrylate ester copolymers, styrene-acrylate ester-methacrylate ester copolymers, styrene-α-methyl chloracrylate copolymer, styrene-acrylonitrile-acrylate ester copolymers, and styrene-vinyl methyl ether copolymers; polyester resins; epoxy resins; polyurethane modified epoxy resins; silicone modified epoxy resin; vinyl chloride resins; rosin modified maleic acid resins; phenyl resins; polyethylene; polypropylene; ionomer resins; polyurethane resins; silicone resins; ketone resins; ethylene-ethylacrylate copolymers; xylene resins; polyvinyl butyral resins; terpene resins; phenolic resins; and aliphatic or alicyclic hydrocarbon resins may be used alone or in mixtures.

To the binder resins, a colorant, a release agent, a charge control agent or the like can be added. As for full-color colorants, Carbon Black, Lamp Black, Magnetite, Titan Black, Chrome Yellow, Ultramarine Blue, Aniline Blue, Phthalocyanine Blue, Phthalocyanine Green, Hansa Yellow G, Rhodamine 6G, Chalcone Oil Blue, Quinacridon, Benzidine Yellow, Rose Bengal, Malachite Green lake, Quinoline Yellow, C.I. Pigment red 48:1, C.I. Pigment red 57:1, C.I. Pigment red 122, C.I. Pigment red 184, C.I. Pigment yellow 12, C.I. Pigment yellow 17, C.I. Pigment yellow 97, C.I. Pigment yellow 180, C.I. Solvent yellow 162, C.I. Pigment blue 5:1, and C.I. Pigment blue 15:3 can be used alone or in mixtures.

As for the release agents, paraffin wax, micro wax, microcrystalline wax, candelilla wax, carnauba wax, rice wax, montan wax, polyethylene wax, polypropylene wax, oxygen convertible polyethylene wax, and oxygen convertible polypropylene wax are exemplified. Among these waxes, polyethylene wax, polypropylene wax, carnauba wax, or ester wax is preferably used.

As for the charge control agents, Oil Black, Oil Black BY, Bontron S-22 (available from Orient Chemical Industries, Ltd.), Bontron S-34 (available from Orient Chemical Industries, Ltd.); metal complex compounds of salicylic acid such as E-81 (available from Orient Chemical Industries, Ltd.), thioindigo type pigments, sulfonyl amine derivatives of copper phthalocyanine, Spilon Black TRH (available from Hodogaya Chemical Co., Ltd.), calix arene type compounds, organic boron compounds, quaternary ammonium salt compounds containing fluorine, metal complex compounds of monoazo, metal complex compounds of aromatic hydroxyl carboxylic acid, metal complex compounds of aromatic dicarboxylic acid, and polysaccharides are exemplified. Among these charge control agents, achromatic or white agents are especially preferred for color toner.

As for the ratios of the components in the toner mother particle, the colorant is preferably from 0.5 to 15 parts by weight and more preferably from 1 to 10 parts by weight; the release agent is preferably from 1 to 10 parts by weight and more preferably from 2.5 to 8 parts by weight; and the charge control agent is preferably from 0.1 to 7 parts by weight and more preferably from 0.5 to 5 parts by weight, all on the basis of 100 parts by weight of the binder resin.

In the toner of the pulverization method, in order to improve the transfer efficiency, the toner is preferably spheroidized. It is preferable to use such machine as ones which allow the toner to be pulverized into relatively spherical particles in a pulverizing step. For example, by using a turbo mill (available from Turbo Industries, Ltd.) known as a mechanical pulverizer, the degree of circularity can be increased up to 0.93. Alternatively, by using a hot-air spheroidizing apparatus (available from Nippon Pneumatic Mfg. Co., Ltd.), the degree of circularity of the pulverized toner can be increased up to 1.00.

The toner mother particles according to the invention include those which can be obtained by a polymerization method and those which can be obtained by a solution suspension method to be described below, in which the average sphericity thereof is controlled to be from 0.95 to 0.99. When the degree of circularity is smaller than 0.95, a desired transfer efficiency can not be obtained, while when the degree of circularity is larger than 0.99, a problem is generated in the cleaning property.

Next, the toner of the polymerization method can be obtained by a suspension polymerization method, an emulsion polymerization method, a dispersion polymerization method or the like and is appropriate for a full-color toner. In the suspension polymerization method, a monomer composition in which a complex containing a polymerizable monomer, a colorant, a release agent and optionally a dye, a polymerization initiator, a cross-linking agent, a charge control agent and other additives is dissolved or dispersed is added in the aqueous phase containing a suspension stabilizer (water-soluble polymer; inorganic material hardly soluble in water) with stirring, granulated, and polymerized, to form a colored polymerized toner particle having a desired particle size. In the materials to be used in preparation of the toner by the polymerization method, as for the colorants, a release agent and a charge control agent, the same materials as those described for the pulverized toner can be used. In the emulsion polymerization method, a monomer and a release agent and optionally a polymerization initiator, an emulsifier (surfactant) and the like can be dispersed in water and polymerized, and then a colorant, a charge control agent and a coagulating agent (electrolyte) and the like can be added in a coagulating step, to form a colored toner particle having a desired particle size.

As for the polymerizable monomer components, styrene, o-methylstyrene, m-methylstyrene, p-methylstyrene, α-methylstyrene, p-methoxystyrene, p-ethylstyrene, vinyl toluene, 2,4-dimethylstyrene, p-n-butylstyrene, p-phenylstyrene, p-chlorostyrene, di-vinylbenzene, methyl acrylate, ethyl acrylate, propyl acrylate, n-butyl acrylate, isobutyl acrylate, n-octyl acrylate, dodecyl acrylate, hydroxyethyl acrylate, 2-ethylhexyl acrylate, phenyl acrylate, stearyl acrylate, 2-chloroethyl acrylate, methyl methacrylate, ethyl methacrylate, propyl methacrylate, n-butyl methacrylate, isobutyl methacrylate, n-octyl methacrylate, dodecyl methacrylate, hydroxyethyl methacrylate, 2-ethylhexyl methacrylate, stearyl methacrylate, phenyl methacrylate, acrylic acid, methacrylic acid, maleic acid, fumaric acid, cinnamic acid, ethylene glycol, propylene glycol, maleic anhydride, phthalic anhydride, ethylene, propylene, butylene, isobutylene, vinyl chloride, vinylidene chloride, vinyl bromide, vinyl fluoride, vinyl acetate, vinyl propionate, acrylonitrile, methacrylonitrile, vinyl methyl ether, vinyl ethyl ether, vinyl ketone, vinyl hexyl ketone, vinyl naphthalene and the like are exemplified. Further, as for fluorine-containing monomers, since fluorine atoms in, for example, 2,2,2-trifluoroethylacrylate, 2,2,3,3-tetrafluoropropylacrylate, vinylidene fluoride, trifluoroethylene, tetrafluoroethylene, trifluoropropylene and the like can be used as binder resins in the negative chargeable toner in which the fluorine atoms are effective in negative charge control.

As for the emulsifies (surfactants), for example, sodium dodecylbenzene sulfate, sodium tetradecyl sulfate, sodium pentadecyl sulfate, sodium octyl sulfate, sodium oleate, sodium laurate, potassium stearate, calcium oleate, dodecyl ammonium chloride, dodecyl ammonium bromide, dodecyl trimethyl ammonium bromide, dodecyl pyridinium chloride, hexadecyl trimethyl ammonium bromide, dodecyl polyoxyethylene ether, hexadecyl polyoxyethylene ether, lauryl polyoxyethylene ether, and sorbitan monooleate polyoxyethylene ether are exemplified.

As for the polymerization initiators, for example, potassium persulfate, sodium persulfate, ammonium persulfate, hydrogen peroxide, 4,4'-azobis-cyanovaleric acid, t-butyl hydroperoxide, benzoylperoxide, and 2,2'-azobis-isobutyronitrile are exemplified.

As for the coagulants (electrolytes), for example, sodium chloride, potassium chloride, lithium chloride, magnesium chloride, calcium chloride, sodium sulfate, potassium sulfate, lithium sulfate, magnesium sulfate, calcium sulfate, zinc sulfate, aluminum sulfate, and iron sulfate are exemplified.

As for adjusting methods for the degree of circularity of the toner prepared by the polymerization method, in the case of the emulsion polymerization method, the degree of circularity can be freely changed within the range of from 0.94 to 1.00 by controlling the temperature and time in a coagulating process of secondary particles, while in the case of the suspension polymerization method, since this method enables to make perfect spherical toner particles, the degree of circularity can be arranged in the range of from 0.98 to 1.00. Further, an average sphericity can appropriately be adjusted in the range of from 0.95 to 0.99 by heat-deforming the toner particles at a temperature higher than the Tg glass-transition temperature of the toner.

Next, the toner prepared by the solution suspension method is described. As for the binder resins, the binder resins as described for the pulverized toners can be used. However, from the viewpoint of a color forming property and the like, a polyester resin is preferred. As for such polyester resins, those described in JP 2003-140380 A are exemplified, and a blend of a cross-linking type polyester resin which is a dehydration-condensation product among a polybasic carboxylic acid, and diols having a high molecular weight and a high viscosity, and a branched- or straight-chain type polyester resin which has a low molecular weight and a low viscosity is preferred. Further, those each having an acidic group such as a carboxyl group, a sulfonic group or a phosphoric acid group are preferred. Among these polyester resins, a polyester resin having a carboxyl group is preferred. The polyester resin having an acid value of from 3 to 20 mg KOH/g is preferred. Such acid value is realized by adjusting a reaction ratio between two functional carboxylic acids and diols or by using anhydrous trimellitic acid as a polybasic component. Since the polyester resin having a carboxyl group is excellent in the dispersion stability and can be negatively-chargeable when made to a toner mother particle, thus such the polyester resin being preferred.

The toner mother particle based on the solution suspension method is preferably prepared by the method as described in JP 2003-140380 A while using the binder resin obtained in such manner as described above. After the binder resin, the colorant described in the pulverized toners and optionally a release agent or a charge control agent are dissolved and dispersed in an organic solvent, the resultant solution dissolved and dispersed in the organic solvent is gradually loaded with an aqueous medium, to cause a phase inversion emulsification and then form a fine particle of mixture. After such the fine particles are coagulated with each other and granulated into a colorant-containing resin fine particle having a desired size, such resin fine particle is subjected to each of the steps of separating, rinsing and drying, to prepare a toner mother particle. In the solution suspension method, the toner mother particle can be prepared while controlling emulsification and association.

In the steps for dissolution-dispersion in the organic solvent, it is preferable that after the binder resin is dissolved in the organic solvent, the colorant which has preliminarily been dispersed is further added thereto to prepare a solution dissolved and dispersed in the organic solvent. Further, in the phase inversion emulsifying step, it is preferable that deionized water (aqueous medium) containing a basic neutralizing agent is gradually added to the dissolved and dispersed solution to form a suspended and emulsified solution, and on this occasion, it is preferable that water may be added such that a ratio of water to a total of the organic solvent and the added water be from 35 to 65% by weight.

As for the basic neutralizing agents to be used in the phase inversion emulsification, inorganic bases and organic bases such as sodium hydroxide, potassium hydroxide, ammonia, diethyl amine, and triethyl amine are illustrated. As for organic solvents, hydrocarbons, halogenated hydrocarbons, ethers, ketones and esters are mentioned and specifically, hexane, heptane, toluene, xylene, cyclohexane, methyl cyclohexane, methyl chloride, dichloromethane, ethyl chloride, propyl chloride, dioxane, tetrahydrofuran, acetone, methyl ethyl ketone, ethyl acetate, and propyl acetate can be used alone or in mixtures of two or more species. Further, as for mixing apparatuses to be used in the emulsifying step, emulsify-dispersing machines such as a homomixer, slasher, a homogenizer, a colloid mill, a media mill, and a cavitron can be used.

A number average particle size of the toner mother particles according to the invention or toner particles to be described below is preferably 9 μm or less, more preferably 4.5 to 9 μm, and more preferably from 8 to 4.5 μm in terms of all of the toner mother particles based on the pulverization method, the toner mother particles based on the polymerization method, and the toner mother particles based on the solution suspension method. In the toner particles in which the number average particle size is larger than 9 μm, even when a latent image is formed at a degree of resolution of 1200 dpi or more, reproducibility of the degree of resolution is decreased as compared with the toner having a smaller particle size, while when it becomes 4.5 μm or less, a hiding-property by the toner is decreased and further the amount of the external additive to be used for increasing flowability is increased and as a result, a fixing property tends to be decreased.

In the number-based particle size distribution of the toner mother particles, it is preferable that an integrated value of particles having an average particle size of 3 μm or less is 1% or less, and preferably 0.8% or less. When the integrated value of an average particle size of 3 μm or less is more than 1%, electrification by a toner layer control member becomes insufficient and then not only a reversibly chargeable toner is generated, but also filming is generated on a latent image carrier, which is not preferred.

The number average particle size of the above-described toner mother particles according to the invention or the toner particles to be described below, the particle size diameter, and an average sphericity are denoted as values measured by using a flow-type particle image analyzer (FPIA-2100; manufactured by Sysmex Corporation).

As for the toner mother particles, it is preferable that a toner particle is as close to a perfect sphere as possible. Specifically, it is preferable that, in the toner mother particle, an average sphericity (R) represented by the following formula is set to be from 0.95 to 0.99, and preferably from 0.972 to 0.983:

$$R=L_0/L_1,$$

wherein $L_1$ (μm) represents a peripheral length of the projected image of the toner particle to be measured; and $L_0$ (μm) represents a peripheral length of a true circle (perfect geometric circle) having the same area as that of the projected image of the toner particle to be measured. By such setting as described above, the tone in which transfer efficiency is high, variance of the transfer efficiency is small even in the case of continuous printing, a chargeable amount is stabilized, and cleanability is excellent can be obtained.

When the average degree of circularity (R) is smaller than 0.95, there are problems that the shape of the toner mother particles is almost changed from the spherical shape to the irregular shape, the flowability in the mixing processing tank is poor, the yield is lowered even when the peripheral velocity of the stirring blade is lowered, the amount of the positively chargeable toner is increased, the distribution of the charged amount becomes wider, the fogging is increased upon generation of lines or the use as a toner. When the average degree of circularity (R) is larger than 0.99, the shape of the toner mother particles becomes close to the spherical shape, thus it being difficult that the external additive is uniformly adhered to the toner mother particles. For this reason, the peripheral velocity of the stirring blade should be increased, which causes generation of melt-deposition on the edge of the blade or the wall of the processing tank, thus the yield being lowered, and the amount of the external additive to be freed and the amount of the positively chargeable toner are increased, thus there being the tendency that the distribution of the charged amount becomes wider and the fogging and the generation of lines are easily generated.

Next, the work function (Φ) is known as energy necessary of drawing out an electron from a relevant material and as the work function is smaller, it becomes easier to draw out the electron; on the other hand as the work function is larger, it becomes harder to draw out the electron. For this reason, it is considered that, when an alumina fine particle which has a smaller work function than that of the negatively-chargeable toner mother particle is externally added to the toner mother particle, the toner mother particle can be made to be more negatively chargeable and comes to have an excellent adhesiveness to the alumina fine particle.

In the invention, the work function ($\Phi_t$) of the toner mother particle is preferably from 5.2 to 5.8 eV; and the work function ($\Phi_A$) of the alumina fine particle is preferably from 4.8 to 5.3 eV.

The work function is measured by a measuring method as described below and digitized as an energy (eV) for drawing out an electron from a relevant material and then chargeability to be generated from contacts with various types of materials can be evaluated. The work function is measured by using a surface analyzer (AC-2; manufactured by Riken Keiki Co., Ltd.; low-energy electron computing method). According to the invention, in the surface analyzer, while a heavy hydrogen lump is used, a radiation amount for a development roller plated with a metal is set to be 10 nW, whereas the radiation amount for each of other members is set to be 500 nW, a monochromatic beam is selected by a spectrograph and then samples are each radiated with a spot size of 4 square mm, an energy scanning range of from 3.4 to 6.2 eV, and a measuring time of 10 sec/one point. The quantity of photoelectrons emitted from each sample surface is detected. The work function is calculated by using a work function calculating software based on the quantity of photoelectrons and measured with repeatability (standard deviation) of 0.02 eV. For the environment for measurement which ensures the repeatability of data, the samples to be measured are left for 24 hours under the conditions of a temperature of 25° C. and a humidity of 55% RH.

Figure 1B:
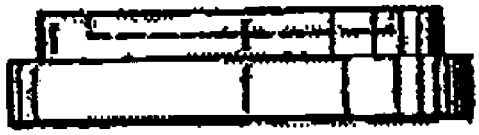

In the case of measuring the work function of the sample toner, a measurement cell for exclusive use in the toner has a configuration in which a stainless steel disc which is 13 mm in diameter and 5 mm in height and is provided at the center thereof with a toner receiving concavity which is 10 mm in diameter and 1 mm in depth as shown in FIGS. 1A and 1B is used. For measurements, the toner is entered in the concavity of the cell by using a weighting spoon without pressure and then is leveled by using a knife edge. The measurement cell filled with the toner is fixed to a sample stage at a predetermined position. Then, the measurement is conducted under the conditions such that the radiation amount is set to be 500 nW, the spot size is set to be 4 square mm, and the energy scanning range is set to be from 4.2 to 6.2 eV.

Figure 2A:
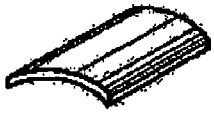
FIGS. 2A and 2B is an explanatory view illustrating a method for measuring the work function of a cylindrical member of the image forming apparatus.
Figure 2B:
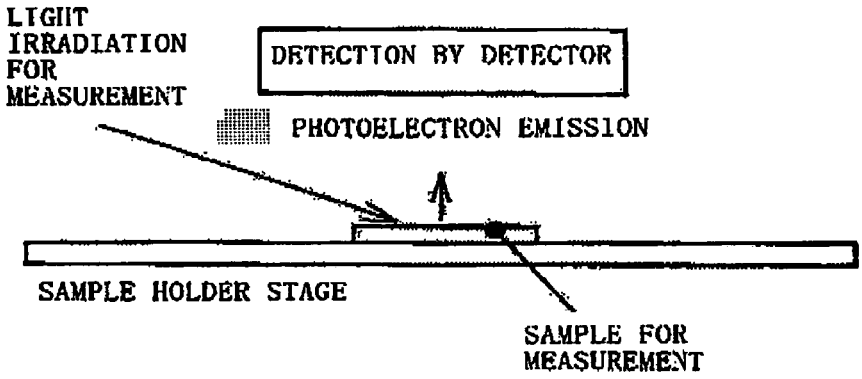

In the case in which the sample is a cylindrical member of the image forming apparatus such as a photoreceptor or a development roller to be described below, the cylindrical member of the image forming apparatus is cut to have a width of from 1 to 1.5 cm and is further cut in the lateral direction along ridge lines so as to obtain a test piece of a shape as shown in FIG. 2A. The test piece is fixed to the sample stage at the predetermined position in such a manner that a surface to be radiated is parallel to the direction of radiation of measurement light as shown in FIG. 2B. Accordingly, photoelectron emitted from the test piece can efficiently be detected by a detector (photoelectron multiplier) In the case in which the sample is an intermediate transfer belt, a regulating blade, or a sheet-like photoreceptor, such a member is cut to have at least 1 square cm as a test piece because the radiation is conducted to a spot of 4 square mm, as described below. Then, the test piece is fixed to the sample stage and measured in the same manner as described with reference to FIG. 2B.

Figure 3:
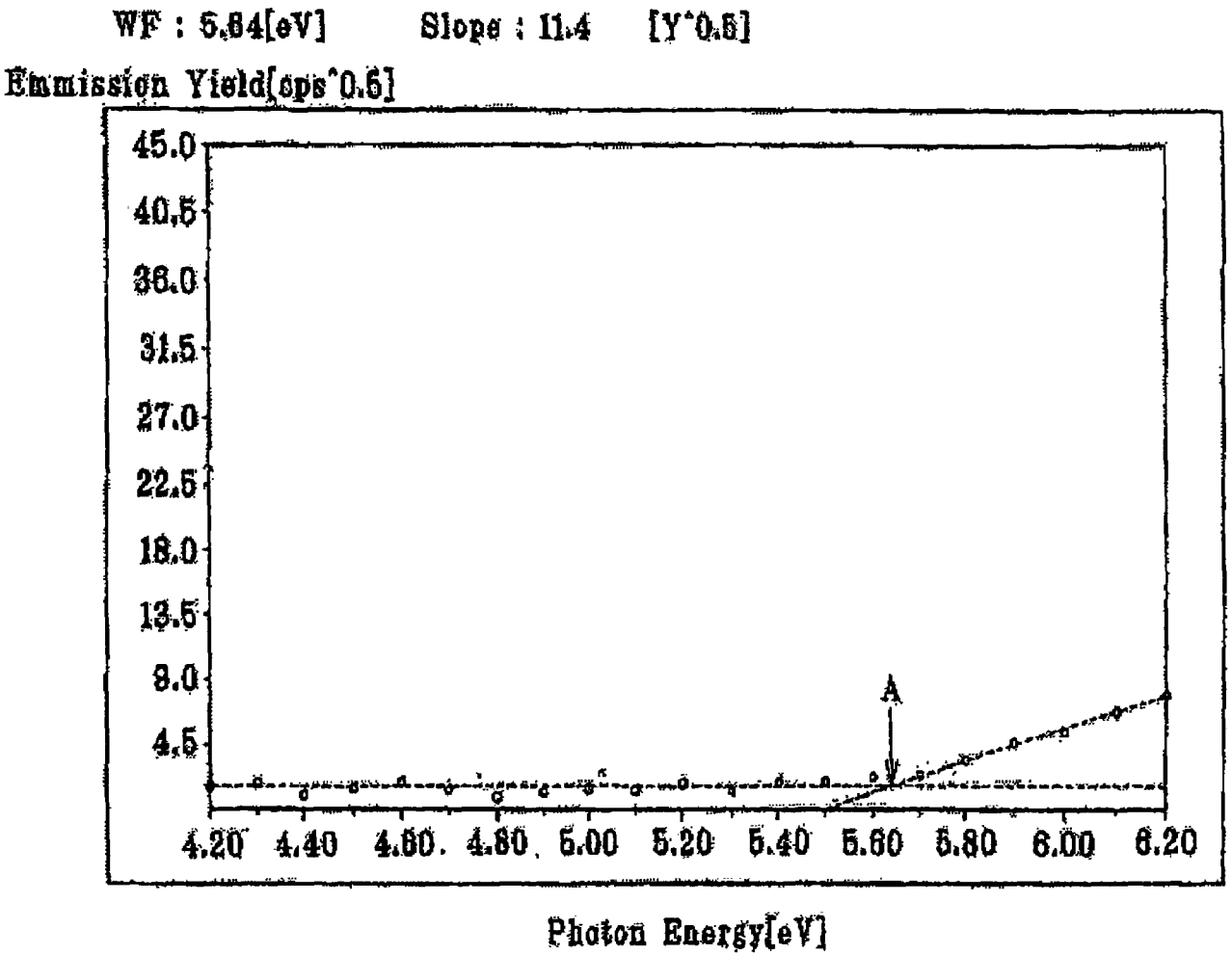
FIG. 3 is an example of a chart which measured a work function of a toner using a surface analyzer.

In this surface analysis, photon emission is started at a given energy value (eV) while scanning excitation energy of monochromatic beam from the lower side to the higher side. Such energy value as described above is called as "work function (eV)". FIG. 3 shows an example of the charts obtained concerning the toner. In FIG. 3, the excitation energy (eV) is plotted as abscissa against a normalized photon yield (nth power of photoelectron yield per unit photon) occurs as ordinate. A given value in gradient (Y/eV) can be obtained. In FIG. 3, the work function is indicated in terms of the excitation energy value (eV) at a critical point (A) thereof.

Next, production examples of the toner mother particles based on the solution suspension method according to the invention and properties thereof will be described.

Production Example 1 of Toner Mother Particle

A polycondensed polyester resin (HIMER ES-801; available from Sanyo Chemical Industries, Ltd.; ratio by weight of the non-crosslinked component to the crosslinked component: 45/55) 110 parts by weight; carnauba wax 55 parts by weight; and cyan pigment (phthalocyanine α-type) 55 parts by weight were melt-kneaded by using a pressure kneader, and the melt-kneaded mixture was cooled. The resultant was roughly pulverized into pieces of from 1 to 2 square mm and then 210 parts by weight of the melt-kneaded pulverized product, 80 parts by weight of the above-described polycondensed polyester resin and 245 parts by weight of methyl ethyl ketone were mixed with stirring by using a colloid mill manufactured by Nihon Seiki Kaisha, Ltd.

Subsequently, the resultant was added with 1 N aqueous ammonia, the mixture was sufficiently stirred and added with 160 parts by weight of deionized water, and then the mixture was stirred for one hour at 30° C. The resultant was added with 150 parts by weight of deionized water dropwise, to cause a phase inversion emulsification and prepare a fine particle dispersion. Next, the prepared dispersion was added with 400 parts by weight of deionized water, the mixture was heated up to a temperature which is a melting point or higher of methyl ethyl ketone to drive off the solvent, and then finally the solid content was adjusted to be about 34%.

Next, 235 parts by weight of the obtained fine particle dispersion was diluted with deionized water to adjust a solid content to about 20% and then added with 60 parts by weight of 20% saline, the temperature was raised to 68° C., the mixture stirred for 60 minutes and then added with 0.6 part by weight of a nonionic emulsifier NL-250 (available from Daiichi Kogyo Seiyaku Co., Ltd.), and then the mixture was stirred for 4 hours at 70° C., to accomplish granulation.

The resultant slurry was separated by using a centrifuge, washed and then dried by using a vibration fluidized-layer apparatus (manufactured by Chuo Kakohki Co., Ltd.) such that a water content in the toner mother particle was allowed to be 0.5% or less in terms of ratio by weight, to obtain cyan toner mother particles.

The obtained cyan toner mother particles were subjected to measurements by using a "flow-type particle image analyzer FPIA-2100" (manufactured by Sysmex Corporation) and the number average particle size and the average sphericity are shown in Table 2, further the work function was measured with a radiation amount of 500 nW by using a "Photoelectron analyzer" (AC-2, manufactured by Riken Keiki Co., Ltd.) and the results are shown in Table 1 in the same manner as above. On this occasion, the integrated value of an average particle size of 3 μm or less was 0.34%.

Production Example 2 of Toner Mother Particle

Magenta toner mother particles were prepared in the same manner as in the production example 1 of the toner mother particles except that the colorant was replaced by Carmin 6B. The number average particle size, the average sphericity, and the work function of the obtained magenta toner mother particles are shown in Table 1 in the same manner as above. On this occasion, the integrated value of an average particle size of 3 μm or less was 0.76%.

Production Example 3 of Toner Mother Particle

Yellow toner mother particles were prepared in the same manner as in the production example 1 of the toner mother particles except that the colorant was replaced by P.Y.155. The number average particle size, the average sphericity, and the work function of the obtained yellow toner mother particles are shown in Table 1 in the same manner as above. On this occasion, the integrated value of an average particle size of 3 μm or less was 0.31%.

Production Example 4 of Toner Mother Particle

Black toner mother particles were prepared in the same manner as in the production example 1 of the toner mother particles except that the colorant was replaced by surface treated Carbon Black 1 (Carbon M1000; manufactured by Mitsubishi Chemical Corporation). The number average particle size, the average sphericity and the work function of the obtained black toner mother particles are shown in Table 1 in the same manner as above. On this occasion, the integrated value of an average particle size of 3 μm or less was 0.31%.

Production Example 5 of Toner Mother Particle

Cyan toner mother particles were prepared in the same manner as in the production example 1 of the toner mother particles except that the polycondensed polyester resin was replaced by a 50:50 (in terms of ratio by weight) mixture (available from Sanyo Chemical Industries, Ltd.) of a polycondensed polyester resin between an aromatic dicarboxylic acid and an alkylene etherized bisphenol A, and a product in which the polycodensed polyester resin is partially cross-linked with a polyvalent metallic compound and further the colorant was replaced by phthalocyanine β-type. The number average particle size, the average sphericity and the work function of the obtained cyan toner mother particles are shown in Table 1 in the same manner as above. On this occasion, the integrated value of an average particle size of 3 μm or less was 0,33%.

Production Example 6 of Toner Mother Particle

Magenta toner mother particles were prepared in the same manner as in the production example 5 of the toner mother particles except that the colorant was replaced by dimethyl quinacridone. The number average particle size, the average sphericity, and the work function of the obtained magenta toner mother particles are shown in Table 1 in the same manner as above. On this occasion, the integrated value of an average particle size of 3 μm or less was 0.42%.

Production Example 7 of Toner Mother Particle

Yellow toner mother particles were prepared in the same manner as in the production example 5 of the toner mother particles except that the colorant was replaced by P.Y.93. The number average particle size, the average sphericity, and the work function of the obtained yellow toner mother particles are shown in Table 1 in the same manner as above. On this occasion, the integrated value of an average particle size of 3 μm or less was 0.32%. of Toner Mother Particle Black toner mother particles 2 were prepared in the same manner as in the production example 5 of the toner mother particles except that the colorant was replaced by surface-treated Carbon Black 2 (Carbon M1000; manufactured by Mitsubishi Chemical Corporation). The number average particle size, the average sphericity, and the work function of the obtained black toner mother particles are shown in Table 1 in the same manner as above. On this occasion, the integrated value of an average particle size of 3 μm or less was 0.31%.

TABLE 1

| Toner mother particle | Number average particle size | Average circularity | Work function (eV) |
|---|---|---|---|
| Cyan toner mother particle 1 | 6.57 | 0.977 | 5.34 |
| Magenta toner mother particle 1 | 6.51 | 0.979 | 5.60 |
| Yellow toner mother particle 1 | 6.51 | 0.979 | 5.60 |
| Black toner mother particle 1 | 6.52 | 0.978 | 5.43 |
| Cyan toner mother particle 2 | 6.53 | 0.981 | 5.33 |
| Magenta toner mother particle 2 | 6.50 | 0.979 | 5.51 |
| Yellow toner mother particle 2 | 6.55 | 0.978 | 5.58 |
| Black toner mother particle 2 | 6.52 | 0.978 | 5.45 |

Further, the value of the work function of each colorant is shown in Table 2.

TABLE 2

| | Colorant | Work function (eV) |
|---|---|---|
| Cyan 1 | Phthalocyanine α-type | 5.16 |
| Cyan 2 | Phthalocyanine β-type | 5.12 |
| Magenta 1 | Carmin 6B | 5.53 |
| Magenta 2 | Dimethyl quinacridone | 5.36 |
| Yellow 1 | P.Y.155 | 5.62 |
| Yellow 2 | P.Y.93 | 5.50 |
| Black 1 | Surface-treated carbon black 1 | 5.24 |
| Black 2 | Surface-treated carbon black 2 | 5.28 |

As is apparent from Tables 1 and 2, it is fount that, although the work function of the toner mother particles based on the solution suspension method varies depending on the components such as a resin and a charge control agent, it is significantly influenced by the kinds of the colorants. This feature indicates that the colorant is distributed or exposed in the vicinity of the surfaces of the toner mother particles.

Next, the external additives will be described in detail. The negatively chargeable spherical toner according to the invention is a toner in which an alumina fine particle having a large particle size with a number average particle size being from 0.1 to 1.0 μm is externally added to a toner mother particle. By externally adding the alumina fine particle having a large particle size, not only the durability of the toner becomes improved, but also the toner becomes excellent in the developing property as a spacer particle at a time of non-contact development. The alumina fine particle is in general industrially produced by a so-called Bayer process, namely, treating bauxite as a raw material with sodium hydroxide to obtain aluminum hydroxide and then calcining the obtained aluminum hydroxide in the air to allow it to be an α-type alumina. However, since a large amount of sodium content remains in such alumina fine particle as produced above and impairs an electric insulating property, various types of alumina fine particles have been developed such that the retype alumina fine particles of high purity having a sodium content of 100 ppm or less and of a narrow particle distribution is described in, for example, JP 8-290914 A and further, a method for producing the α-type alumina fine particles by treating with an acid is described in JP 2003-26419 A and still further, it is described in JP 7-41318 A that desired α-type alumina having a desired number average particle size and a desired particle size distribution of a primary particle can be obtained by adding a fluoride-type mineralizer and a seed crystal of an α-type alumina particle to an alumina source as a raw material and then calcining the resultant mixture at 1500° C. or less.

Outline of Production Examples of α-Type Alumina Fine Particles 1 and 2

An α-type alumina fine particles can be obtained by pulverizing transition alumina which is obtained by precalcining aluminum hydroxide produced by a Bayer process which is the method as described in JP 8-290914 A such that a number average particle size be from 0.1 to 0.3 nm, and then calcining the pulverized transition alumina in an atmospheric gas containing 1% by volume or more of a hydrogen chloride gas and 0.1% by volume or more of steam at a temperature of from 1150 to 1300° C. "AKP-53" (produced by Sumitomo Chemical Co., Ltd.) was used as α-type alumina 1 which had been produced by the method described above, while "AKP-50" (produced by Sumitomo Chemical Co., Ltd.) was used as α-type alumina 2 which had been produced by the method described above.

Outline of Production Examples of Alumina Fine Particles 3 and 5

An α-type alumina fine particles can be obtained by defining aluminum hydroxide produced by a Bayer process which is the method as described in JP 7-41318 A and a transition alumina pulverized such that a number average particle size came to be from 0.2 to 0.5 nm as raw-material alumina and then adding from 0.02 to 0.3% by weight of fluoride-type mineralizer and 5% by weight of α-type alumina fine particles having a number average particle size of 1 μm or less to the raw-material alumina in terms of alumina and then calcining the resultant mixture at 1350° C. "LS-235" (produced by Nippon Light Metal Co., Ltd.) was used as α-type alumina 3 which had been produced by the method described above, while "LS-250" (produced by Nippon Light Metal. Co., Ltd.) was used as α-type alumina 5 which had been produced by the method described above.

Outline of Production Examples of α-Type Alumina Fine Particle 4

An α-type alumina fine particles can be obtained by a method described in JP 2003-26419 A in which, after 10% by weight of DL-lactic acid is added to an aqueous solution containing 23% by weight of basic aluminum chloride in terms of aluminum, the resultant mixture is subjected to a hydrothermal treatment for 20 hours at 120° C. under a pressure of 2 kg/cm$^2$ and then heat-dried at 60° C. to change it into a gel in which a number average particle size is from 0.1 to 0.3 nm and then the resultant composite gel is subjected to a heating treatment in the air at about 600° C. "TM-D" (produced by Taimei Chemical Co., Ltd.) was used as α-type alumina 4 which was produced by the method described above.

Each of the physical properties of the alumina fine particles is shown in Table 3. Further, a particle size of the external additive according to the invention is obtained by actually measuring the particle sizes of arbitrary 500 particles of images produced by an electromicroscope of one million magnifications and the value denotes a number average particle size.

TABLE 3

| Alumina fine particle | Particle size size (μm) | BET specific surface area (m$^2$/g) | Work function (eV) |
|---|---|---|---|
| α-type alumina 1 | 0.21 ($D_p$50) | 15 | 4.92 |
| α-type alumina 2 | 0.23 ($D_p$50) | 14.5 | 5.06 |
| α-type alumina 3 | 0.45 ($D_p$50) | 8.9 | 5.15 |
| α-type alumina 4 | 0.10 ($D_p$50) | 13.5 | 5.17 |
| α-type alumina 5 | 0.59 ($D_p$50) | 7.8 | 5.22 |

In the course of studying suitability of the above described various types of alumina fine particles as the external additives to the toner mother particles, the present inventor has found that the work function ($\Phi_A$) can take various types of values in the range of from 4.9 t 5.3 depending on the production methods and thus it is not a constant value. In the negatively chargeable spherical toner according to the invention, as described below, the α-type alumina fine particles in which, by allowing the work function ($\Phi_t$) of the toner mother particles to be larger than the work function ($\Phi_A$) of the alumina fine particles by at least 0.4 eV, the negatively chargeable toner mother particles can be more negatively-chargeable and also, can enhance an adherence to the externally added alumina fine particles and further, a difference between respective work functions of the above-described toner mother particles and alumina fine particles becomes at least 0.4 eV may be selected. For example, the work function in production example 1 of the above-described toner mother particles is 5.34 eV and on this occasion, an α-type alumina 1 is preferred as the α-type alumina fine particles.

The amount of the alumina fine particles each having a large particle size to be added to the toner mother particles is preferably in the range of from 0.05 to 1.3 part by weight, and more preferably from 0.1 to 1.0 part by weight, based on 100 parts by weight of the toner mother particles. When the amount thereof is smaller than 0.05 part by weight, it can not function as a spacer, while when it is larger than 1.3 part by weight, the amount of alumina fine particles of large particle size to be freed becomes large, which is not preferred.

Further, other external additives than alumina fine particles will be described in detail. Firstly, negatively-chargeable silica fine particles imparted with hydrophobic property are illustrated.

As for the negatively-chargeable silica fine particles, those having a number average particle size of preferably from 4 to 120 nm, more preferably from 5 to 70 n, and more preferably from 6 to 60 nm are used. As the number average particle size of the negatively-chargeable silica fine particles becomes smaller, flowability of the toner to be obtained becomes higher; however, when the number average particle size thereof is smaller than 4 nu, they are liable to be buried in the toner mother particles, while, when it is more than 120 nm, the flowability thereof is liable to be remarkably aggravated.

As for the negatively-chargeable silica fine particles, those having a uniform particle size may singly be used; however, two types or more of negatively-chargeable silica fine particles having different number average particle sizes from one another may simultaneously be used. Although the negatively-chargeable silica fine particles having a smaller number average particle size (silica of small particle size) have ordinarily been used, by simultaneously using the negatively-chargeable silica fine particles having a larger number average particle size (silica of large particle size) along therewith, not only an absolute value of the charge amount can be large compared with a case in which only the silica of small particle size is used, but also the silica of large particle size becomes a resistor and prevents the silica of small particle size from being buried in the toner mother particles; therefore, a long-term charge stability comes to be excellent. Further, it becomes possible to improve the flowability of the toner, exert a blocking effect against heat and then, enhance the storability of the toner. It is preferable to simultaneously use the negatively-chargeable silica fine particles having a number average particle size of preferably from 5 to 20 nm, more preferably from 6 to 15 nm as a silica of small particle size and the negatively-chargeable silica fine particles having a number average particle size of preferably from 20 to 70 nm, more preferably from 20 to 60 nm as a silica of large particle size. Still further, a difference between the number average particle sizes of the silica of large particle size a n d the silica of small particle size is preferably 10 nm or more, more preferably 20 nm or more.

It is preferable from the standpoint of imparting the toner with flowability as well as obtaining a long-term charge stability when the mixing ratio of the silica of large particle size to the silica of small particle size is preferably from 1:3 to 3:1, more preferably from 1:2 to 2:1, and still more preferably from 1:1.5 to 1.5:1 in terms of a weight ratio. In a case in which the silica of large particle size and the silica of small particle size are simultaneously used, they may simultaneously be added to the toner mother particles after being mixed with each other or separately be added one first and then the other.

The amount of the negatively-chargeable silica fine particles to be added can be varied depending on a particle size distribution, flowability or the like of the toner mother particles or a particle size distribution, a desired charge amount or the like of the external additives. For example, the silica of small particle size is added in an amount of, based on 100 parts by weight of the toner mother particles, preferably from 0.5 to 2.0 parts by weight, more preferably from 0.7 to 1.5 parts by weight. The silica of large particle size is added in an amount of, based on 100 parts by weight of the toner mother particles, preferably from 0.2 to 2.0 parts by weight, more preferably from 0.3 to 1.5 parts by weight. When the silica of small particle size and the silica of large particle size are simultaneously used, while taking the above-described mixing ratio into consideration, they are added in an amount, based on 100 parts by weight of the toner mother particles, of preferably from 0.5 to 3.0 parts by weight, more preferably from 0.7 to 2.5 parts by weight in total It is preferable that the negatively-chargeable silica fine particles are subjected to a hydrophobicity-imparting treatment. By allowing surfaces of the negatively-chargeable silica fine particles to be hydrophobic, flowability and chargeability of the toner is further enhanced. The hydrophobicity-imparting treatment is performed by a method ordinarily used in the art, such as a wet method, a dry method, or the like, while using a silane compound such as aminosilane, hexamethyldisilazane, or dimethyldichlorosilane; or a silicone oil such as dimethyl silicone, methyl phenyl silicone, fluorine-modified silicone oil, an alkyl-modified silicone oil, an amino-modified silicone oil or an epoxy-modified silicone oil. As for hydrophobic negatively-chargeable silica fine particles, commercial products such as RX200 and AX50 (available from Nippon Aerosil Co., Ltd.), TG811F, TG810G and TG308F (available from Cabot Corporation) are illustrated.

The work function of the hydrophobic silica particles is in the range of preferably from 5.0 to 5.3 and is more preferably set to be 0.05 eV or smaller than that of the toner mother particles. By such setting as described above, charge transfer is caused by the difference in work function and then, the hydrophobic silica particles are allowed to firmly adhere to the toner mother particles.

As for the external additives according to the invention, in addition to silica fine particles which have been subjected to the hydrophobicity-imparting treatment, titanium oxide fine particles having a relatively small electric resistivity are added. Titanium oxide can take a crystal form of rutile type, anatase type, rutile/anatase type or the like. Titanium oxide of any crystal form may be used, but titanium oxide of a rutile/anatase type is preferably used for the reason that the adjustment of electric charge is easy and a rutile/anatase type titanium oxide is difficult to be buried in toner mother particles even when the number of sheets of printing increases. The size of titanium oxide fine particles is not particularly restricted but it is preferred that the particle size or major axis length be 10 to 200 nm. In the case of a rutile/anatase type titanium oxide, titanium oxide fine particles having the major axis length of from 10 to 200 nm or so are preferred.

Titanium oxide fine particles are added in an amount of preferably from 0.2 to 2.0 parts by weight, more preferably from 0.3 to 1.5 parts by weight, based on 100 parts by weight of the toner mother particles. The weight ratio of titanium oxide fine particles to positively-chargeable silica fine particles is preferably from 1:3 to 3:1 from the point of capable of adjusting electric charge without causing extreme reduction of electrical resistance of the toner.

By making the surfaces of titanium oxide fine particles hydrophobic, the fluctuation of the chargeability of the toner due to the changes in external environment can be lessened (that is, a stable chargeability can be maintained), and the flowability of the toner can be improved, which is preferred. Imparting the hydrophobicity to the titanium oxide fine particles is performed in a same manner as in imparting the hydrophobicity to the above-described negatively-chargeable silica fine particles. As for the hydrophobic titanium oxide fine particles, STT-305 (available from Titan Kogyou Kabushiki Kaisha) and the like are illustrated.

The work function of the hydrophobic titanium oxide particles is in the range of preferably from 5.5 to 5.7 eV. The hydrophobic titanium oxide can be externally added to the toner mother particles simultaneously with the hydrophobic silica particles of small particle size. However, when the work function of the toner mother particles and the work function of the titanium oxide particles are almost the same with each other (the absolute difference being within 0.1 eV), the hydrophobic silica particles are first externally added to the toner mother particles and then, the titanium oxide particles may be externally added together with a metallic soap particles to be described below.

When the work function of the hydrophobic titanium oxide particles is almost the same as that of the toner mother particles, the hydrophobic titanium oxide particles become hard to directly adhere to the toner mother particles; on the other hand, since the hydrophobic titanium oxide particles can adhere to the toner mother particles by a contact-potential difference via surfaces of the hydrophobic silica particles small in work function, overchargeability in the hydrophobic silica particles can more effectively be prevented such that the transfer of the electric charge from overcharged hydrophobic silica particles is facilitated, which is preferred.

Inorganic fine particles other than titanium oxide fine particles can be also externally added for the purpose of controlling the chargeability and improving the flowability. For example, as for the inorganic fine particles, fine particles of metallic oxides such as strontium oxide, tin oxide, zirconium oxide, magnesium oxide, and indium oxide; fine particles of nitrides such as silicon nitride; fine particles of carbides such as silicon carbide; fine particles of metallic salts such as calcium sulfate, barium sulfate, and calcium carbonate; and fine particles of composites thereof are mentioned. Fine particles of metallic oxides having a relatively small electric resistivity of $10^9$ Ωcm or less are preferably used. The size of the inorganic fine particles to be added is not particularly limited and is preferably in the range of from 10 to 300 nm. It is preferred that the surfaces of these inorganic fine particles be subjected to a hydrophobicity-imparting treatment for the purpose of improving the stabilization of charging characteristics. The hydrophobicity-imparting treatment of inorganic fine particles is performed by the same method as used in any one of the hydrophobicity-imparting methods of the above-described negatively-chargeable silica fine particles and the positively-chargeable silica fine particles.

Further, in the method for producing the toner according to the invention, after the toner mother particles and the inorganic external additive particles are mixed with one another, the resultant mixture and, as external additives, positively-chargeable silica fine particles and a long-chain fatty acid or a salt thereof may be mixed with one another.

It is preferred that positively-chargeable silica fine particles be subjected to a hydrophobicity-imparting treatment. By making the surfaces of positively-chargeable silica fine particles hydrophobic, the fluctuation of the chargeability of the toner due to the changes in external environment can be lessened (that is, a stable chargeability can be maintained), and the flowability of the toner can be improved, which is preferred. Imparting the hydrophobicity to the positively-chargeable silica fine particles is carried out according to the same method as imparting the hydrophobicity to the above-described negatively-chargeable silica fine particles. As positively-chargeable hydrophobic silica fine particles, commercially available NA50H (manufactured by Nippon Aerosil Co., Ltd.) and TG820F (manufactured by Cabot Corporation) are illustrated.

As for the positively-chargeable silica fine particles, by taking the flowability into consideration, a volume number average particle size thereof is preferably from 10 nm to 50 nm, more preferably from 15 to 40 nm. The positively-chargeable silica fine particles are added in an amount of preferably from 0.1 to 1.0 part by weight, more preferably from 0.2 to 0.8 part by weight, based on 100 parts by weight of the toner mother particles. When the negatively-chargeable resin is used as a binder resin and the negatively-chargeable silica fine particles are not used as a charge control agent, the positively-chargeable silica fine particles are added in an amount of preferably from 0.1 to 2.0 parts by weight, more preferably from 0.3 to 1.5 parts by weight, based on 100 parts by weight of the toner mother fine particles.

The toner mother particles according to the invention may be externally added with metallic soap particles in addition to the above-described external additive particles. By such addition, a liberation ratio for the number of the liberated external additive particles is decreased when allowed to be toner particles and then, generation of fogging can be prevented. As for the metallic soap particles, metallic salts of higher fatty acids selected from zinc, magnesium, calcium and aluminum salts, such as magnesium stearate, calcium stearate, zinc stearate, monoaluminum stearate, and trialuminum stearate are mentioned. A number average particle size of the metallic soap particles may be set to be preferably from 0.5 to 20 μm, more preferably from 0.8 to 10 μm.

The amount of the metallic soap particles to be added is in the range of preferably from 0.05 to 0.5 part by weight, more preferably from 0.1 to 0.3 part by weight, based on 100 parts by weight of the toner mother particles. When the amount is less than 0.05 part by weight, a function as a lubricant and a function as a binder come to be insufficient. When it is more than 0.5 part by weight, fogging tends to be increased. Further, the amount of the metallic soap particles to be added may be in the range of from 2 to 10 parts by weight. When it is less than 2 parts by weight, based on 100 parts by weight of the external additive, the effects as the lubricant and binder are not shown. On the other hand, when the amount is more than 10 parts by weight, the flowability tents to be decreased or the fogging tends to be increased, which is not preferred.

Further, the work function of the metallic soap particles is in the range of preferably from 5.3 to 5.8 and is preferably almost the same as that of the toner mother particles (the absolute difference is within 0.15 eV, preferably within 0.1 eV).

Figure 7:
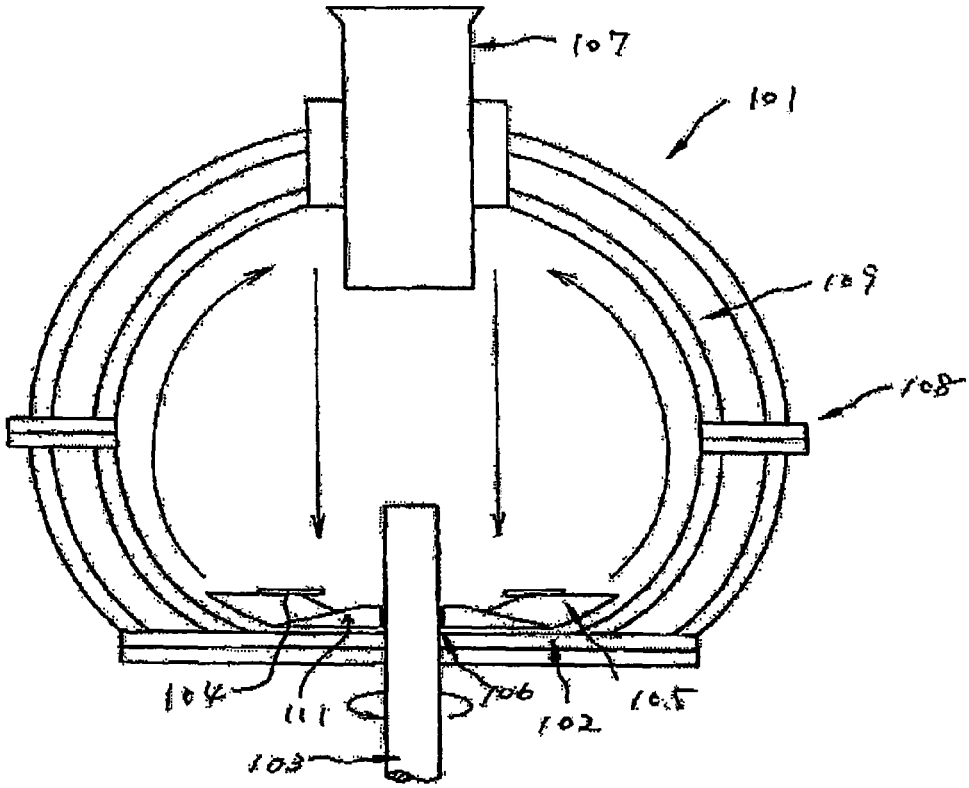
FIG. 7 is a central cross-sectional view showing the spherical mixing tank.
Figure 8:
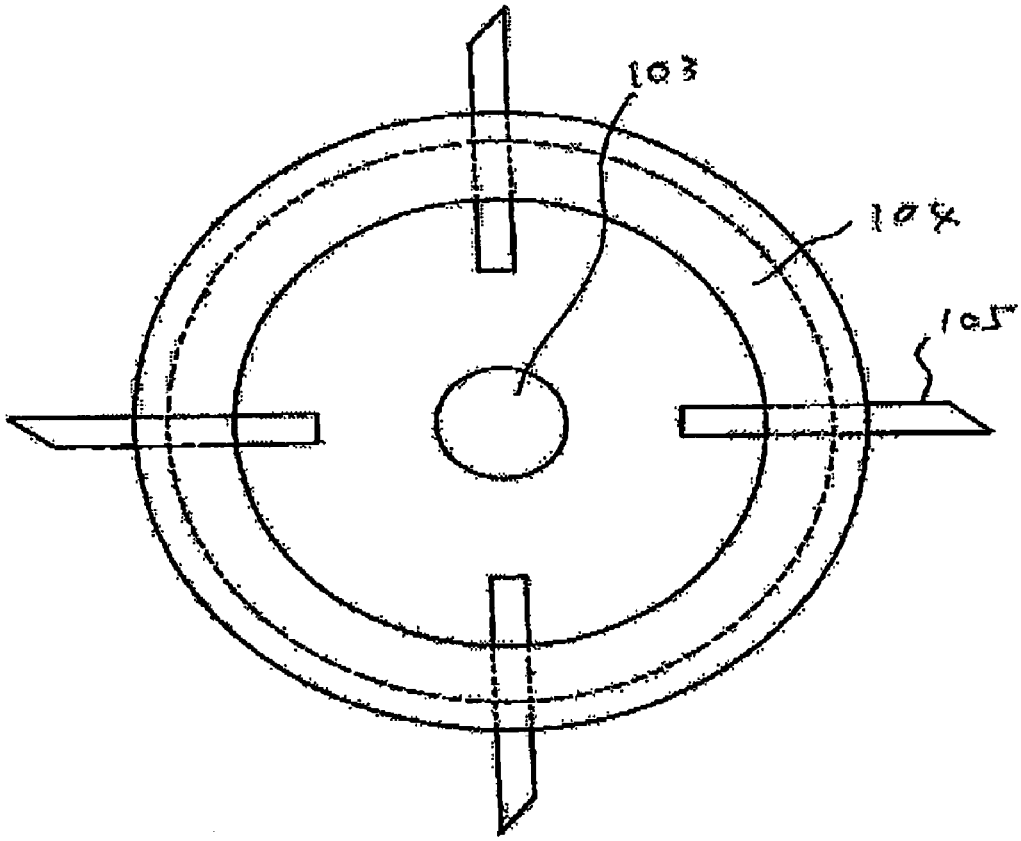
FIG. 8 is a plan view showing an example of the mixing blade.

Next, the mixing processing process of the toner mother particles and an external additive according to the invention will be described. In the mixing processing of the toner mother particles and the external additive particles, spherical mixing processing tanks as shown FIG. 7 and FIG. 8 are used. FIG. 7 is a central cross-sectional view, and FIG. 8 is a plan view showing one example of the mixing blades. In the Figures, 101 represents a processing tank, 102 represents the bottom of a horizontal disc-shaped processing tank, 103 represents a driving shaft, 104 represents a donut-shaped disc, 105 represents a stirring blade, 106 represents an air-sealed hole, 107 represents a cylinder-shaped member, 108 represents a flange, 109 represents a jacket, and 111 represents a disc equipped with the stirring blade.

As shown in FIG. 7 and FIG. 8, the spherical mixing processing tank 101 is equipped with the bottom of the horizontal disc-shaped processing tank 102, and a stirring blade 105 having a cross-section in the conical shape on the rotary driving shaft 103 which vertically penetrates the center of the bottom of the processing tank 102, and a plurality of the stirring blades 105 are relatively equipped on the peripheral edge. The stirring blade 105 is a turbine blade, which can perform the mixing with a relatively low shear action by the blade. Further, the upper part of the stirring blade 105 is equipped with the donut-shaped disc 104 for the purpose of reinforcement.

On the top of the container 101, the cylinder-shaped member 107 which vertically penetrates the top of the mixing processing tank on the extended line of the rotary driving shaft 103 is arranged so as that the edges of the mixing processing tank are located within the upper hemisphere, whereby the sealing air can be discharged. The upper hemisphere in the mixing processing bed can be open or closed from the flange 108 in the central part, and thus the upper hemisphere is open to put the material to be treated therein. The put material to be treated is upwardly discharged spirally (not shown) by a centrifugal force caused by the rotation of the stirring blade 105 along the inner wall of the processing tank 101 by gravity as indicated by the arrow in FIG. 7 and reaches the top, and by lowering the kinetic energy, falls down. The fell material to be treated is slipped down on the upper side in the conical shape and resupplied to the stirring blade 105. By repeating such the process, the dispersing and mixing proceeds. The outlet (not shown) of the material to be treated after completion of the external addition is provided on the lower part of the processing tank 101. Further, the spherical mixing processing tank is equipped with the water-cooling jacket 109, and the cooling water at a temperature as described below flows through at a flow rate to be described later, whereby the contents thereof can be cooled.

The rotary driving shaft 103 is equipped with the stirring blade 105 is made capable of rotating through the air-sealed hole 106, and the edges of the stirring blade 105 are arranged to be located between the periphery of the donut-shaped disc 104 and the inner wall of the processing tank, as shown in FIG. 7 and FIG. 8. Further, the lower edge of the stirring blade 105 becomes arc-shaped one along the spherical inner wall of the processing tank 101 as shown in FIG. 7, and then becomes one having such the shape which is capable of discharging the material to be treated toward the top of the processing tank by rotation along the inner side of the processing tank. The air-sealed hole 106 is a hole for supplying air for the purpose of preventing the material to be treated from invading into the high-temperature parts of the rotary driving shaft, and the supplied air is discharged from the cylinder-shaped member 107.

From the viewpoints of the uniform processibility of the material to be treated, and the dischargibility of the supplied air, the length inside the container of the member 107 for input is favorably at least 1/20, and preferably at least 1/3, of that of the donut-shaped disc 104 inside container, with the upper limit thereof being possibly the length such that the material to be treated is not in contact with the cross-section. Further, the cylinder-shaped member 107 may be of any structure which allows the sealing air to be discharged, for example, the structure having a slit, in addition to the cylinder-shaped ones.

Further, the ratio of the diameter of the bottom of the horizontal processing tank 102 to the diameter of the processing tank 101 is favorably 0.25 to 0.80, the ratio of the external diameter of the donut-shaped disc 104 to the diameter of the bottom of the horizontal processing tank 102 is favorably 0.50 to 1.20, and the ratio of the diameter of the stirring blade 105 tank to the diameter of the processing tank 101 is favorably 0.50 to 0.90. Further, the ratio of the external diameter to the internal diameter of the donut-shaped disc 104 is preferably 0.5 to 0.95, and more preferably 0.7 to 0.8.

The amount of the material to be treated to be put into the spherical mixing processing tank may be such that the ratio is favorably 0.1 to 0.9, and preferably 0.3 to 0.5, based on the volume of the processing tank.

Figure 9:
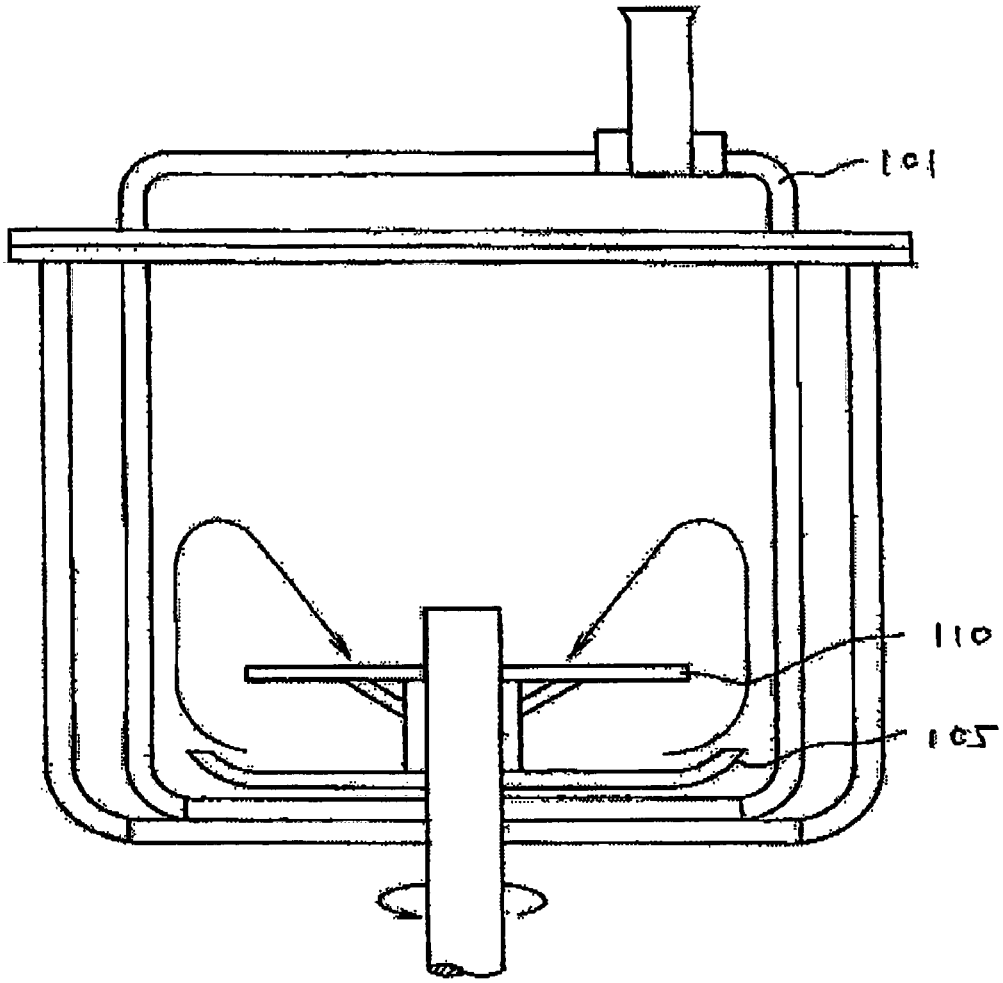
FIG. 9 is a central cross-sectional view showing the Henschel mixer.

As in the Henschel mixer shown in FIG. 9, by using the spherical mixing processing tank, the toner mother particles and the external additive particles can flow with a high speed along the wall of the processing tank in the curve shape while not upwardly moving the material to be treated drastically, and the distance on the wall in which the material to be treated flows is long, and thus uniform external addition can be achieved in a short time. Further, the material to be treated is transferred to the ceiling of the mixing processing tank, and then supplied to the stirring blade on the bottom of the processing tank for retreatment. For this reason, there are obtained an advantage that the upward and downward motion of the material to be treated depending on gravity gets more dynamic, as compared with the cylinder-shaped mixing processing tank, as in the Henschel mixer, and the setup of the upper blade is not required. In addition, in the case where the coagulation of the external additive particles is strong, the concave is provided in the processing tank to cause a turbulent flow, and thus generate disintegration.

When the toner mother particles and a plurality of the external additive particles having different number average particle sizes may be favorably mixed and processed, the plural external additive particles are either mixed and processed separately or dividedly several times in the case where they are belonging to one species, so-called "a multi-stage mixing processing". In the case of preparing a toner using the spherical mixing processing tank, if the mixing processing time is short, the mixing processing is insufficient, while if the mixing processing time is long, the material to be treated is melted and deposited on the wall of the processing tank, the stirring blade or the like, thus the yield being lowered. From this, the processing time is preferably from 0.5 to 10 minutes, and more preferably 1 to 5 minutes. In addition, processed materials in each step may be dividedly mixed several times. Further, from the similar viewpoints, the peripheral velocity of the edge of the stirring blade in the spherical mixing processing tank ($\pi\times$ outermost diameter of the blade$\times$ revolution/time) would be in the range of preferably 10 to 100 m/s.

As for an external addition method, after the toner mother particles may be externally added with an external additive particles such as alumina fine particles of large particle size and hydrophobic silica fine particles, and be finally externally added with the metallic soap particles, the positively-chargeable silica and the like. Further, the toner mother particles may be externally added with the external additive particles of small particle size and alumina fine particles of large particle size separately from each other and charging characteristics of the negatively chargeable spherical toner made therefrom can be stabilized and it is possible to prepare a toner free from fogging and capable of suppressing reduction in transfer efficiency.

Further, the metallic soap particles to be added in a post-process can adhere to the vicinity of the external additive on the surfaces of the toner mother particles or directly to the surfaces of the toner mother particles. By allowing the work functions of the toner mother particles and metallic soap particles to be almost the same with each other, the flowability and chargeability of the toner mother particles can be maintained without impairing properties of imparting the flowability and imparting the chargeability which are functions of inorganic external additives.

As for methods for adding the external additives to the toner mother particles, a method using a Henschel mixer (available from Mitsui Mike Machinery Co., Ltd.), a MECHANOFUSION system (available from Hosokawa Micron Corporation), MECHANOMILL (available from Okada Seiko Co., Ltd.) or the like can also be performed. When the Henschel mixer is used, at the time of adding the hydrophobic silica particles at a first stage, it may be set to be at from 5,000 to 7,000 rpm for from 1 to 3 minutes and, at the time of adding the alumina fine particles of large particle size or the metallic soap particles at a second stage, it may be set to be at from 5,000 to 7,000 rpm for from 1 to 3 minutes.

In the negatively chargeable spherical toner according to the invention, at the stage of the toner mother particles or the toner mother particles externally added with the external additive, a number average molecular weight (Mn) as measured by gel permeation chromatography (GPC) using polystyrene as a standard, in THF-soluble components is in the range of preferably from 1,500 to 20,000, more preferably from 2,000 to 15,000, and still more preferably from 3,000 to 12,000. When the number average molecular weight (Mn) is less than 1,500, although the particles are excellent in low-temperature fixing property, they are inferior in the ability to hold a colorant, filming resistance, offset resistance, fixed image strength and storability. Further, when the number average molecular weight (Mn) is larger than 20,000, the particles are inferior in the low-temperature fixing property. Still further, a weight average molecular weight (Mw) is in the range of preferably from 3,000 to 300,000, more preferably from 5,000 to 50,000. Mw/Mn is in the range of preferably from 1.5 to 20, preferably from 1.8 to 8.

Even still further, a flow softening temperature (Tf1/2) is in a range of preferably from 100 to 140° C. When the flow softening temperature is lower than 100° C., a high-temperature off-set resistance comes to be inferior, while when it is higher than 140° C., a low-temperature fixing property comes to be inferior. Further, a glass transition temperature (Tg) is in the range of preferably from 55 to 70° C. When the glass transition temperature is lower than 55° C., a storability comes to be inferior, while when it is higher than 70° C., a Tf1/2value is also increased therewith and then, a low-temperature fixing property comes to be inferior. Still further, in the toner according to the invention, a melt viscosity upon a 50% rate of efflux is in the range of preferably from $2\times10^3$ to $1.5\times10^4$ Pa·s, to thereby allow the toner to be appropriate for that for oilless fixing.

Still further, the work function of the negatively chargeable spherical toner according to the invention may be in the range of generally from 5.25 to 5.85 eV, preferably from 5.35 to 5.8 eV. When the work function of the toner is less than 5.25 eV, there is a problem in that a usable application range of a latent image carrier or an intermediate transfer medium is narrowed and further, when it is more than 5.85 eV, which means that the content of the colorant in the toner is decreased, there is a problem in that a coloring property is deteriorated.

Even still further, in toners of four colors: yellow, magenta, cyan, and black, it is preferable that the kinds of a binder, a colorant, an external additive and the like constituting the toner particles are appropriately selected within above-described respective ranges of work functions of the toners and then, the work function of the toner particles to be obtained may be adjusted such that the difference in work function therebetween is in a range of at least 0.02 eV. Then, at the time of superposing colors of toners of four colors one on top of another, as for the toner to be firstly developed or transferred, the work function may be set to be largest as being in the range of from 5.8 to 5.6 eV and, as for a toner for a second color to be superposed on the first color, the work function may be set as being in the range of from 5.7 to 5.5 eV, as for a toner for a third color to be superposed on the second color and a toner for a fourth color to be finally superposed on the third color, the work functions may be set to be smaller in order as being in the range of from 5.6 to 5.4 eV and from 5.5 to 5.25 eV, respectively. Particularly, the toner for the first color may have the work function of at least 5.6 eV.

Figure 4:
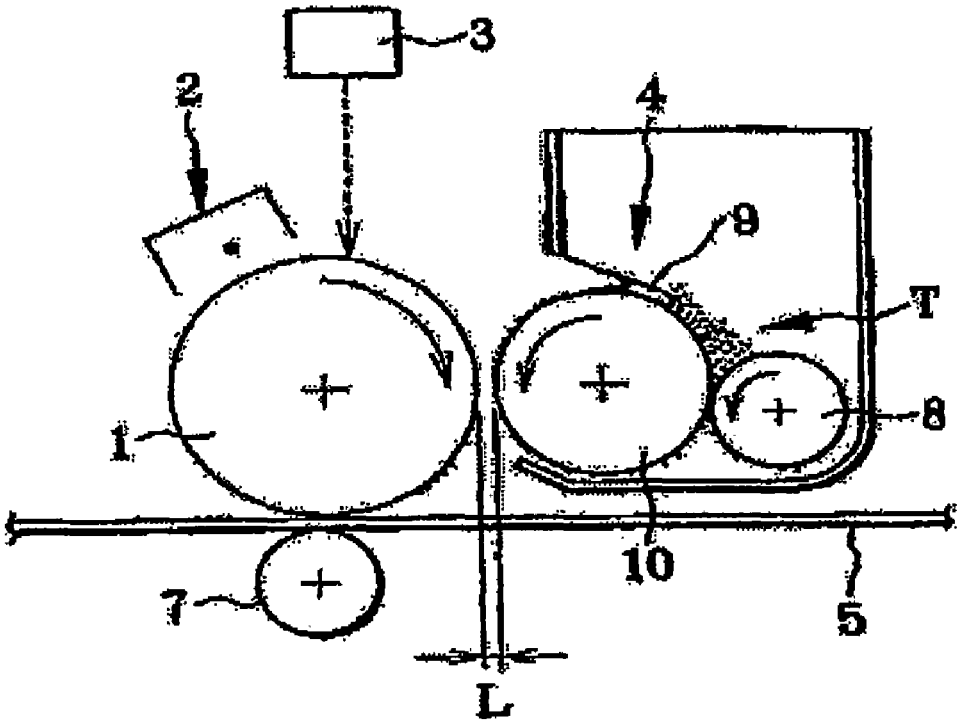
FIG. 4 is an explanatory view illustrating a non-contact development type according to an image forming apparatus of the invention.

Next, a color image forming apparatus according to the invention will be described in detail. FIG. 4 is a diagram for explaining relations among a latent image carrier, a development unit and an intermediate transfer medium in the color image forming apparatus according to the invention. In the latent image carrier 1, a charging means 2, an exposing means 3, a developing means 4 and an intermediate transfer medium 5 are arranged. Further, although not shown, the latent image carrier may be provided with a roll brush (fur brush) as a cleaning means. In another case, the latent image carrier is not provided with the cleaning means, but the intermediate transfer medium is provided with the cleaning means and may have a cleanerless type. In FIG. 4, reference numeral 7 designates a back-up roller; reference numeral 8 designates a toner-supplying roller; reference numeral 9 designates a toner regulating blade (toner layer thickness regulating member); reference numeral 10 designates a development roller; a mark T designates a negatively chargeable spherical toner; and a mark L designates a developing gap.

The latent image carrier 1 is a photoreceptor drum which has a diameter of preferably from 24 to 86 mm and rotates at a surface velocity of preferably from 60 to 300 mm/sec. After the surface thereof is uniformly negatively charged by a corona charging device 2, the latent image carrier 1 is subjected to an exposure 3 in accordance with information to be recorded. In this manner, an electrostatic latent image is formed thereon.

The latent image carrier may be of an organic single layer type or an organic multi-layer laminated type. An organic multi-layer laminated type photoreceptor is made by sequentially laminating a charge generation layer and a charge transport layer on a conductive support via an undercoat layer.

As for the conductive support, a known conductive support, for example, having conductivity of volume resistivity $10^{10}$ Ω·cm or less can be used. Specific examples of the conductive supports include a tubular support of 20 mm to 90 mmϕ formed by, for example, machining an aluminum alloy, an article made of polyethylene terephthalate film which is provided with conductivity by chemical vapor deposition of aluminum or conductive paint, and a tubular support of 20 mm to 90 mmϕ formed by a conductive polyimide resin. Besides the tubular shape, the conductive support may have a belt-like shape, a plate shape, or a sheet shape. In addition, a seamless metallic belt made of, for example, a nickel electrocast tube or a stainless steel tube may suitably be employed.

As for the undercoat layer provided on the conductive support, a known undercoat layer may be used. For example, the undercoat layer is disposed for improving the adhesive property, preventing moire phenomenon, improving the coating property of the charge generation layer as an upper layer thereof, and/or reducing residual potential during exposure. The resin as the material of the undercoat layer preferably has high insoluble property relative to a solvent used for a photosensitive layer because the undercoat layer is coated with the photosensitive layer. Examples of available resins are water-soluble resins such as polyvinyl alcohol, casein, and sodium polyacrylate; alcohol-soluble resins such as vinyl acetate, copolymer nylon, and methoxymethylated nylon; polyurethane; a melamine resin; and an epoxy resin. The foregoing resins may be used alone or in combination of two or more types. These resins may contain metallic oxide such as titanium dioxide or zinc oxide.

As for the charge generation pigment for use in the charge generation layer, a known material may be used. Specific examples of charge generation pigments include phthalocyanine pigments such as metallic phthalocyanine, and metal-free phthalocyanine; azulenium salt pigments; squaric acid methine pigments; azo pigments having a carbazole skeleton, azo pigments having a triphenylamine skeleton, azo pigments having a diphenylamine skeleton, azo pigments having a dibenzothiophene skeleton, azo pigments having a fluorene skeleton, azo pigments having an oxadiazole skeleton, azo pigments having a bisstilbene skeleton, azo pigments having a distyryl oxadiazole skeleton, and azo pigments having a distyryl carbazole skeleton; perylene pigments; anthraquinone pigments; polycyclic quinone pigments; quinone imine pigments; diphenylmethahe pigments; triphenylmethane pigments; benzoquinone pigments; naphthoquinone pigments; cyanine pigments; azomethine pigments; indigoid pigments; and bisbenzimidazole pigments. The foregoing charge generation pigments may be used alone or in combination of two or more types.

Examples or the binder resins for use in the charge generation layer include a polyvinyl butyral resin, a partially acetalized polyvinyl butyral resin, a polyarylate resin, and a vinyl chloride-vinyl acetate copolymer. As for the structural ratio between the binder resin and the charge generation material, the charge generation material is in the range of preferably from 10 to 1000 parts by weight relative to 100 parts by weight of the binder resin in terms of a weight ratio.

As for charge transport materials for use in the charge transport layer, known materials may be used and the charge transport materials are divided into electron transport materials and positive hole transport materials. Examples of the electron transport materials include electron acceptor materials such as chloroanil, tetracyanoethylene, tetracyanoquinodimethane, 2,4,7-trinitro-9-fluorenone, palladiphenoquinone derivatives, benzoquinone derivatives, and naphthoquinone derivatives. These electron transport materials may be used alone or in combination of two or more types.

Examples of positive hole transport materials include oxazole compounds, oxadiazole compounds, imidazole compounds, triphenylamine compounds, pyrazoline compounds, hydrazone compounds, stilbene compounds, phenazine compounds, benzofuran compounds, buthaziene compounds, benzizine compounds, and derivatives thereof. These electron donor materials may be used alone or in combination of two or more types. The charge transport layer may contain an antioxidant, an age resistor, an ultraviolet ray absorbent or the like for preventing deterioration of the aforementioned materials.

Examples of the binder resins for use in the charge transport layer include polyester, polycarbonate, polysulfone, polyarylate, polyvinyl butyral, polymethyl methacrylate, a polyvinyl chloride resin, a vinyl chloride-vinyl acetate copolymer, and a silicone resin. Among these, polycarbonate is preferable in view of the compatibility with the charge transport material, the film strength, the solubility, and the stability as a coating material. As for a structural ratio between the binder resin and the charge transport material, the charge transport material is in the range of preferably from 25 to 300 parts by weight relative to 100 parts by weight of the binder resin in terms of a weight ratio.

It is preferable to use a coating liquid for forming the charge generation layer and the charge transport layer. Example of solvents for use in the coating liquid include alcohols such as methanol, ethanol, and isopropyl alcohol; ketones such as acetone, methyl ethyl ketone, and cyclohexanone; amides such as N,N-dimethylformamide and N,N-dimethylacetamide; ethers such as tetrahydrofuran, dioxane and ethylene glycol monomethyl ether; esters such as methyl acetate and ethyl acetate; aliphatic halogenated hydrocarbons such as chloroform, methylene chloride, dichloroethylene, carbon tetrachloride, and trichloroethylene; and aromatic hydrocarbons such as benzene, toluene, xylene, and monochlorobenzene. Selection from the above solvents depends on the kind of used binder resin.

For dispersing the charge generation pigment, it is preferable to disperse and mix by using a mechanical method such as a sand mill method, a ball mill method, an attritor method, or a planetary mill method.

Examples of coating methods for the undercoat layer, the charge generation layer and the charge transport layer include a dip coating method, a ring coating method, a spray coating method, a wire bar coating method, a spin coating method, a blade coating method, a roller coating method, and an air knife coating method. After coating, it is preferable to dry them at room temperature and then, heat-dry them at a temperature of from 30 to 200° C. for from 30 to 120 minutes. The thickness of the charge generation layer after being dried is in the range of preferably from 0.05 to 10 μm, more preferably from 0.1 to 3 μm. The thickness of the charge transport layer after being dried is in the range of preferably from 5 to 50 μm, more preferably from 10 to 40 μm.

A single layer type organic photoreceptor layer is manufactured by applying and forming a single layer type organic photosensitive layer containing a charge generation material, a charge transport material, a sensitizer, a binder, a solvent, and the like via a similar undercoat layer on a conductive support as described in the aforementioned organic multilayer laminated type photoreceptor. The negatively-chargeable single layer type organic photoreceptor may be prepared in accordance with the method disclosed in JP 2000-19746 A.

Examples of charge generation materials for use in the single layer type organic photosensitive layer include phthalocyanine pigments, azo pigments, quinone pigments, perylene pigments, quinocyanine pigments, indigoid pigments, bisbenzimidazole pigments, and quinacridone pigments. Among these, phthalocyanine pigments and azo pigments are preferable. Examples of charge transport materials include organic positive hole transport compounds such as hydrazone compounds, stilbene compounds, phenylamine compounds, arylamine compounds, diphenyl buthaziene compounds, and oxazole compounds. Examples of the sensitizers include electron attractive organic compounds such as palladiphenoquinone derivatives, naphthoquinone derivatives, and chloroanil, which are also known as electron transport materials. Examples of the binders include thermoplastic resins such as a polycarbonate resin, a polyarylate resin, and a polyester resin.

Proportions of the respective components are preferably the binder: from 40 to 75% by weight; the charge generation material: from 0.5 to 20% by weight; the charge transport material: from 10 to 50% by weight; and the sensitizer; from 0.5 to 30% by weight, preferably the binder: from 45 to 65% by weight; the charge generation material: from 1 to 20% by weight; the charge transport material: from 20 to 40% by weight; and the sensitizer: from 2 to 25% by weight. The solvent is preferably a solvent being insoluble relative to the undercoat layer. Examples of the solvents include toluene, methyl ethyl ketone, and tetrahydrofuran.

The respective components are pulverized, dispersed, and mixed by using an agitator such as a homo mixer, a ball mill, a sand mill, an attritor, a paint conditioner so as to prepare a coating liquid. The coating liquid is applied onto the undercoat layer according to a dip coating method, a ring coating method, a spray coating method and, after that, is dried to have a thickness preferably from 15 to 40 μm, more preferably from 20 to 35 μm so as to form the single layer organic photoreceptor layer.

The developing device reversely develops an electrostatic latent image on the latent image carrier in a non-contact manner, to thereby form a visible image. The developing device which houses' the toner T is constituted with a toner-containing portion which is not replenished with the toner and a development unit comprising a development roller 10. The toner is supplied to the development roller 10 by a supply roller 8 which rotates anticlockwise (as shown). The development roller rotates anticlockwise (as shown), transports the toner T transported by the supply roller 8 to a portion which faces off against the latent image carrier, while holding the toner adsorbed onto the surface thereof, to thereby make the electrostatic latent image on the latent image carrier 1 visible.

As for the development roller, a roller in which a surface of a metallic pipe having a diameter of from 16 to 24 mm is treated with plating or blasting or that in which a conductive elastic layer made of NBR, SBR, EPDM, urethane rubber, silicone rubber or the like having a volume resistivity of from $10^4$ to $10^8$ Ω·cm and a hardness of from 40 to 70° is formed on a peripheral surface of a center shaft thereof (Asker A hardness) can be used. A developing bias voltage is applied to the development roller via a shaft of the pipe or the center shaft thereof.

As for the regulating blade 9, an article in which an SUS, a phosphor bronze, a rubber plate, or a metal sheet is pasted with a rubber tip is used. The work function at a face being in contact with the toner may be from 4.8 to 5.4 eV and may be smaller than that of the toner. The regulating blade is biased against the development roller by a biasing device such as a spring or the like (not shown) or by utilizing a bouncing force as an elastic member with a linear load of preferably from 0.08 to 0.6 N/cm so as to regulate an amount of the toner to be transported to be preferably from 0.3 to 0.6 mg/cm$^2$, the thickness of the toner layer on the development roller to be preferably from 5 to 20 μm, preferably from 6 to 10 μm and the number of layers made up of toner particles comes to be approximately 1, to thereby allow the toner particles to have a sufficient frictional electrification. When the toner layer thickness on the development roller is regulated to be 2 layers or more (an amount of the toner to be transported is 0.7 mg/cm$^2$ or more), the evasion of the spherical toner from friction occurs and a frictional charging operation can not sufficiently be performed and further, the toner of small particle size passes without being in contact with a toner layer regulating member and comes to be positively charged and then, tends to be mixed in a toner layer after subjected to regulation, to cause fogging or deterioration of the transfer efficiency. Charging amount of the toner may be controlled by performing a charge injection to the toner contacting to the blade by applying a voltage to the regulating blade 9.

The development roller 10 faces off against the latent image carrier 1 via a developing gap L. The developing gap L is preferably in the range of from 100 to 350 μm. Although not shown, a developing bias of a direct current voltage (DC) is preferably in the range of from −200 to −500 V and an alternating current voltage (AC) to be superimposed on the direct current voltage is preferably in the range of from 1.5 to 3.5 kHz with a P-P voltage in the range of from 1000 to 1800 V. The peripheral velocity of the development roller which rotates anticlockwise is preferably set to have a ratio of peripheral velocity of preferably from 1.0 to 2.5, more preferably from 1.2 to 2.2 relative to the latent image carrier which rotates clockwise.

In a portion at which the latent image carrier faces off against the development roller, the toner T vibrates between the surface of the development roller and the surface of the latent image carrier to develop an electrostatic latent image. The toner particles and the latent image carrier come to be in contact with each other during the vibration of the toner 8 between the surface of the development roller and the surface of the latent image carrier and then, the positively chargeable toner, even though existing, comes to be negatively charged from the relation with the work function to be described below.

Next, an intermediate transfer medium 5 is transferred to a position between the latent image carrier 1 and a back-up roller (transfer roller) 7. The transfer roller presses the intermediate transfer medium to be in contact with the latent image carrier and simultaneously, is applied with a voltage of polarity reverse to the negatively chargeable toner as a transfer voltage.

As for intermediate transfer mediums, an electronically-conductive transfer drum and a transfer belt are illustrated. Firstly, such transfer mediums of the transfer belt type can be divided into two types using substrates. One of them is a type in which a transfer layer, namely, a surface layer, is provided on a film or a seamless belt made of a resin, while the other is a type in which the transfer layer, namely, the surface layer, is provided on a substrate layer which is an elastic body. Further, transfer mediums of the drum type can also be divided into two types using substrates. One of them is a type in which, when the latent image carrier is a case in which an organic photosensitive layer is provided on a rigid drum, for example, a drum made of aluminum, a transfer layer which is an elastic surface layer is provided on a rigid drum substrate, such as aluminum, as an intermediate transfer medium. On the other hand, in a case in which a support of the latent image carrier is a so-called "elastic photoreceptor" in which a photosensitive layer is provided on an elastic support, for example, in a belt shape or rubber, a transfer layer which is a surface layer may be provided either directly or via a conductive intermediate layer on a rigid drum substrate, such as aluminum, as an intermediate transfer medium.

As for substrates, known conductive or insulating substrates can be used In a case of the transfer belts, a volume resistivity is in the range of preferably from $10^4$ to $10^{12}$ Ω·cm, more preferably from $10^6$ to $10^{11}$ Ω·cm. They can be divided into two types in accordance with substrates to be applied.

As for materials suitable for films and seamless substrates and production methods therefor, a seamless substrate is first formed by extruding a semiconductive film substrate having a thickness of from 50 to 500 μm prepared by dispersing the conductive material such as conductive carbon black, conductive titanium oxide, conductive tin oxide or conductive silica in an engineering plastic such as modified polyimide, thermosetting polyimide, polycarbonate, an ethylene tetrafluoroethylene copolymer, polyvinylydene fluoride, or a nylon alloy and then a fluorine coating having a thickness of preferably from 5 to 50 μm is applied on the outside of the thus-formed seamless substrate as a surface protective layer for decreasing a surface energy and preventing filming of the toner, to thereby prepare a seamless belt. As for application methods, a dip coating method, a ring coating method, a spray coating method, and other methods can be used. Further, for the purpose of preventing cracking at edges, and elongation and meandering, tapes of PET film or ribs of urethane rubber having a thickness of preferably 80 μm are attached to the both edges of the transfer belt.

When the substrate is prepared by using the film sheet, the belt can be prepared by subjecting an end face to an ultrasonic welding in order to realize a belt shape Specifically, after a conductive layer and a surface layer are provided on a sheet film, the resultant composite is subjected to the ultrasonic welding, to thereby prepare the transfer belt. Further specifically, in a case in which a polyethylene terephthalate film having a thickness of preferably from 60 to 150 μm is used as a substrate, namely, an insulating substrate, aluminum or the like is vapor deposited on a surface thereof and optionally, an intermediate conductive layer composed of a conductive material such as carbon black and a resin is applied thereon and then, onto the layer, a semiconductive surface layer containing a urethane resin, a fluororesin, a conductive material, or fluorine-type fine particles having surface resistance higher than the above-described layer is applied, to thereby prepare a transfer belt. In a case in which a resistance layer which does not require a large amount of heat at the time of drying after such application is provided, it is possible that an aluminum-deposited film is first subjected to the ultrasonic welding and then the above-described resistance layer is provided to prepare the transfer belt.

As for materials suitable for elastic substrates such as rubber and production methods therefor, a material prepared by dispersing the above-described conductive material into silicone rubber, urethane rubber, NBR (nitrile rubber) or EPDM (ethylene propylene rubber) is first extruded into a semiconductive rubber belt having a thickness of preferably 0.8 to 2.0 mm and then the surface of the belt is processed by an abrasive such as a sandpaper or a polisher to control such that the surface has a desired surface roughness. Though this elastic layer can be used without any additional layer, a surface protective layer can be further formed thereon similarly to the above case.

In a case of the transfer drum, a volume resistivity is in the range-of preferably from $10^4$ to $10^{12}$ Ω·cm, more preferably from $10^7$ to $10^{11}$ Ω·cm. The transfer drum can be prepared such that a conductive elastic substrate is formed by optionally providing an elastic conductive intermediate layer on a metallic cylinder made of aluminum or the like and then a semiconductive surface protective layer for reducing the surface energy and preventing filming of toner is made on the thus-formed substrate by, for example, coating fluorine to have a thickness of preferably 5 to 50 μm.

As for conductive elastic substrates, for example, a conductive rubber material is prepared by mixing, kneading, and dispersing a conductive material such as carbon black, conductive titanium oxide, conductive tin oxide or conductive silica into a rubber material such as a silicone rubber, a urethane rubber, NBR (nitrile rubber), EPDM (ethylene propylene rubber), a butadiene rubber, a styrene-butadiene rubber, an isoprene rubber, a chloroprene rubber, a butyl rubber, an epichlorohydrin rubber or a fluororubber. The conductive rubber material is molded onto an aluminum cylinder having a diameter of preferably from 90 to 180 mm and the ground to have a thickness of preferably from 0.8 to 6 mm and a volume resistivity of preferably from $10^4$ to $10^{10}$ Ω·cm. Then, a semiconductive surface layer made of a urethane resin, a fluororesin, a conductive material and fluorine fine particles is formed to have a thickness of preferably about 15 to 40 μm, to thereby form the transfer drum having a desired volume resistivity of preferably from $10^7$ to $10^{11}$ Ω·cm. At this point, the surface roughness is preferably 1 μmRa or less. Further, as another example, a semiconductive tube made of fluororesin or the like is covered onto a conductive elastic substrate formed in the same manner as described above and is shrank by heat, thereby forming a transfer drum having a desired surface layer and a desired electric resistance.

To the conductive layer of the transfer drum or the transfer belt, a voltage of from +250 to +600 V is preferably applied as a primary transfer voltage, and in a secondary transfer to a transfer material such as a paper, a voltage of from +400 to +2800 V is preferably applied as a secondary transfer voltage.

Further, the transfer roller 7 has a metallic shaft having a diameter of preferably from 10 to 20 mm and is provided with an elastic layer, a conductive layer, and a resistance outer layer which are laminated on the peripheral surface of the metallic shaft in this order. The resistance outer layer may be a resistance sheet made by dispersing conductive fine particles such as conductive carbon into a resin such as a fluororesin, a polyvinyl butyral, or a rubber such as polyurethane and thus having excellent flexibility. The resistance outer layer preferably has a smooth surface, a volume resistivity of $10^7$ to $10^{11}$ Ω·cm, preferably $10^8$ to $10^{10}$ Ω·cm, and a thickness of from 0.02 to 2 mm.

The conductive layer may be selected from among a conductive resin made by dispersing conductive fine particles such as conductive carbon particles into a resin such as a polyester resin, a metallic sheet, and a conductive adhesive and preferably has a volume resistivity of $10^5$ Ω·cm or less. The elastic layer is required to elastically deform when the transfer roller is pressed against the latent image carrier and to rapidly return to the original configuration when the pressure is cancelled. Therefore, the elastic layer is made of an elastic material such as foamed sponge rubber. The foamed sponge rubber may have either of the continuous cell (open-cell) structure and the closed-cell structure and preferably has a rubber hardness of from 30 to 80 (Asker C hardness) and a thickness of from 1 to 5 mm. Because of the elastic deformation of the transfer roller, the latent image carrier and the intermediate transfer medium can be in close contact with each other while having a wide nip width. In this case, the pressing load to the latent image carrier by the transfer roller is in the range of from 0.245 to 0.588 N/cm, preferably from 0.343 to 0.49 N/cm.

In a full-color image forming apparatus according to the invention, by allowing the work function of the intermediate transfer medium to be small than that of the toner, toner residues remaining on the latent image carrier after transfer can be transferred onto the intermediate transfer medium and further, toner residues remaining on the intermediate transfer medium after the toner is transferred from the intermediate transfer medium onto the recording material such as a paper can be reduced.

The work function ($\Phi_{opc}$) of the surface of the latent image carrier (photoreceptor) is in the range of preferably from 5.2 to 5.6 eV, more preferably from 5.25 to 5.5 eV. When it is less than 5.2 eV, there is a problem in that selection of a usable charge transfer material comes to be difficult, while when it is more than 5.6 eV, there is a problem in that selection of a usable charge generation material comes to be difficult.

The work function ($\Phi_{tM}$) of the surface of the intermediate transfer medium is in the range of preferably from 4.9 to 5.5 eV, more preferably from 4.95 to 5.45 eV. The work function ($\Phi_{tM}$) of the surface of the intermediate transfer medium larger than 5.5 eV is undesirable because the material design for toner itself should be difficult. On the other hand, the work function of the surface of the intermediate transfer medium smaller than 4.9 eV is also undesirable because the amount of the conductive material in the intermediate transfer medium should be too large so that the mechanical strength of the intermediate transfer medium is reduced.

Further, the work function of the regulating blade may be allowed to be smaller than that of the toner and, in this manner, the generation of the reversely chargeable toner can be further prevented.

By allowing the average circularity R of negatively chargeable spherical toner particles to be as high as preferably from 0.970 to 0.985, the full-color image forming apparatus according to the invention can have high transfer efficiency and, as the color image forming apparatus shown in FIG. 6 to be described below, the latent image carrier can be a cleanerless type (when the latent image carrier is allowed to be a cleanerless type, a cleaning means is provided in the intermediate transfer medium), and by establishing a relation: $\Phi_t > \Phi_{OPC} > \Phi_{tM}$ among the work function ($\Phi_t$) of the spherical toner, the work function ($\Phi_{OPC}$) of the surface of the latent image carrier in the image forming apparatus and the work function ($\Phi_{tM}$) of the intermediate transfer medium, the full-color image forming apparatus can have much more high transfer efficiency and toner residues remaining on the surface of the latent image carrier after the toner is transferred can be reduced.

Further, the work function ($\Phi_{tM}$) of the surface of the intermediate transfer medium can be set to be in the range of from 4.9 to 5.5 eV and the work function of the negatively chargeable spherical toner can be set to be in the range of from 5.25 to 5.85 eV; however, in the full-color image forming apparatus according to the invention, by allowing the work function of the intermediate transfer medium to be 0.2 eV or more smaller than that of the toner, toner residues remaining on the surface of the intermediate transfer medium after the toner is transferred to the recording material such as a paper can be reduced.

Figure 5:
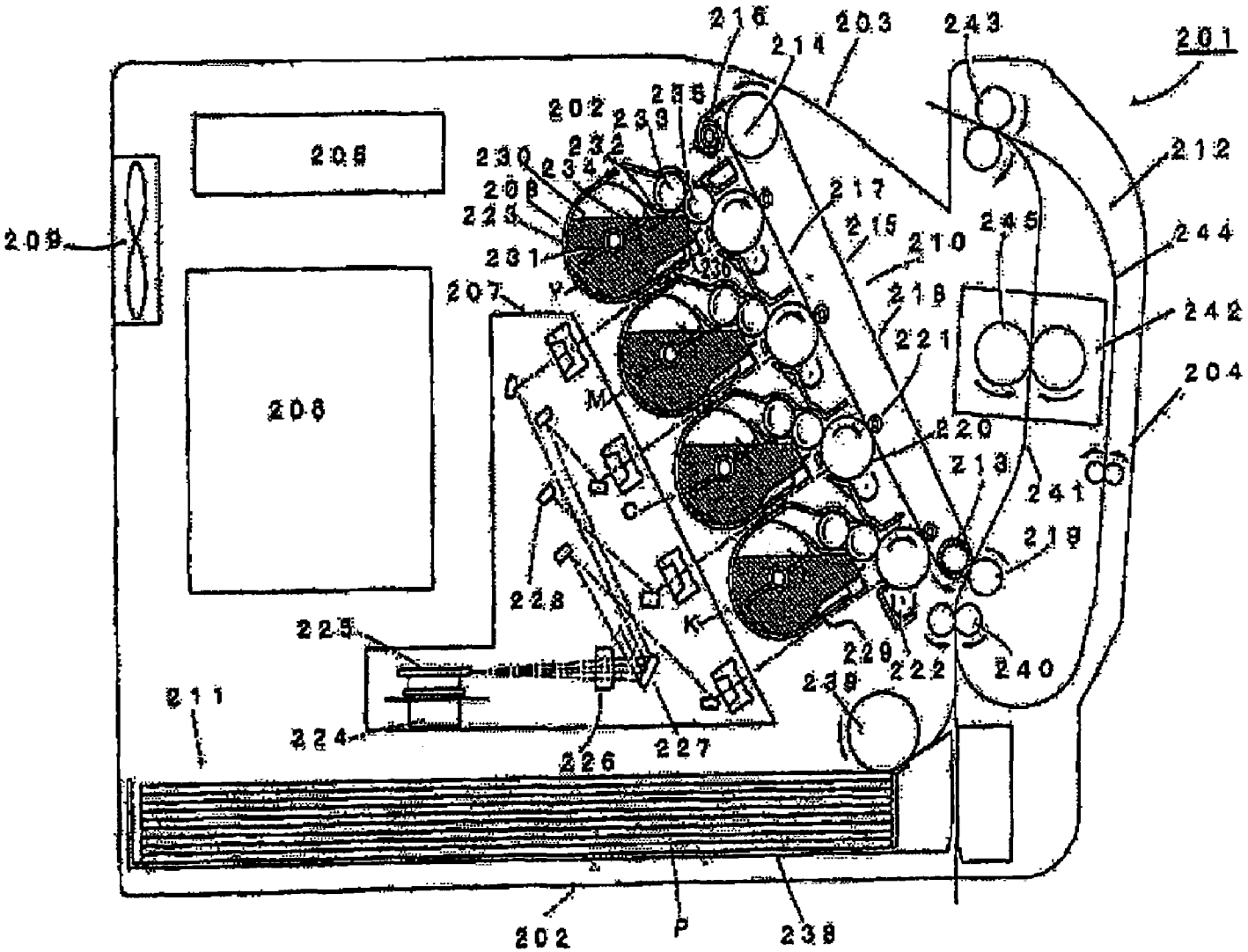
FIG. 5 is an example of a tandem development type full-color image forming apparatus according to the invention.

In the image forming apparatus as shown in FIG. 4, by combining developing devices of conducting developing process with respective four color toners (developers) of yellow Y, cyan C, magenta M, and black K and the photoreceptor, a full-color image forming apparatus can be provided. In FIG. 5, an example of a tandem type is shown, in which a cleaning means is not provided in the latent image carrier, namely, the latent image carrier is allowed to be a cleanerless type. Further, in FIG. 6A, an example of a full-color printer of a rotary type according to the invention is shown, in which a roll brush (fur brush) as shown in FIG. 6B is provided in the latent image carrier as a cleaning means 23.

FIG. 5 is a schematic explanatory diagram of an example of a tandem type color printer according to the invention. The image forming apparatus 201, which is a type of having no cleaning means in the latent image carrier, comprises a housing 202, an ejection tray 203 formed in the upper portion of the housing 202, a door body 204 attached in the front of the housing 202 such that the door body is able to open or close freely. Within the housing 202, a control unit 205, a power source unit 206, an exposure unit 207, an image forming unit 208, an air fan 209, a transfer unit 210, and a paper feeding unit 211 are arranged. Within the door body 204, a paper delivery unit 212 is arranged. The respective units are designed to be detachable relative to the main body of the apparatus, whereby these units can be temporally detached for the purpose of repair or replacement for the time of maintenance.

The transfer unit 210 comprises a driving roller 213 which is disposed in a lower portion of the housing 202 and is driven by a driving means (not shown) to rotate, a driven roller 214 which is disposed diagonally above the driving roller 213, and an intermediate transfer belt 215 which is laid around only the two rollers with certain tension and is driven to circulate in a direction indicated by an arrow (the anticlockwise direction). The driven roller 214 and the intermediate transfer belt 215 are arranged obliquely with respect to the driving roller 213 on the left side of the drawing. Accordingly, a belt tension side (a side tensioned by the driving roller 213) 217 at the time of driving the intermediate transfer belt 215 is on the lower side and a belt slack side 218 is on the upper side.

The driving roller 213 also functions as a back-up roller for a secondary transfer roller 219 described later. Formed on the peripheral surface of the driving roller 213 is a rubber layer which is preferably about 3 mm in thickness and $1\times10^5$ Ω·cm or less in volume resistivity. The driving roller has a metallic shaft which is grounded so as to function as a conductive path for secondary transfer bias supplied through the secondary transfer roller 219. Since the driving-roller 213 is provided with the rubber layer having high friction and shock absorption, impact generated when a recording material is fed into a secondary transfer section is hardly transmitted to the intermediate transfer belt 215, thereby preventing the deterioration of image quality.

Further, the diameter of the driving roller 213 is set to be smaller than the diameter of the driven roller 214. This facilitates the separation of a recording paper after secondary transfer because of the elastic force of the recording paper itself.

The primary transfer members 221 are pressed into contact with the back of the intermediate transfer belt 215 by disposing facing the latent image carriers 220 of the respective monochromatic image forming units Y, M, C, and X, constituting an image forming unit 208 described later. A transfer bias is applied to each primary transfer member 221.

The image forming unit 208 comprises the monochromatic image forming units Y (for yellow), M (for magenta), C (for cyan), and K (for black) for forming different multi-color images (in this embodiment, four-color images). Each monochromatic image forming unit Y, M, C, K has a latent image carrier 220 composed of a photoreceptor in which an organic photosensitive layer and an inorganic photosensitive layer are formed, a charging means 222 composed of a corona charger and a developing means 223 which are arranged around the latent image carrier 220.

Each of monochromatic image forming units Y, M, C, and K is disposed such that the latent image carrier 220 is in contact with the belt tension side 217 of the . intermediate transfer belt 215. As a result of this, each monochromatic image forming unit Y, M, C, R is also arranged obliquely with respect to the driving roller 213 on the left side of the drawing. The latent image carrier 220 is driven to rotate in a counter direction to the intermediate transfer belt 215 as indicated by arrows.

The exposure unit 207 is disposed obliquely below the image forming unit 208 and comprises a polygon mirror motor 224, a polygon mirror 225, an f-θ lens 226, a reflecting mirror 227, and a turn-back mirror 228. In the exposing means, image signals corresponding to the respective colors are formed and modulated according to the common data clock frequency and are then radiated from the polygon mirror 225. The radiated image signals are aimed to the latent image carrier 220 of each monochromatic image forming unit Y, M, C, K via the f-θ lens 226, the reflecting mirror 227 and the turn-back mirror 228, thereby forming latent images. Further, the light path length to the latent image carrier 220 of each monochromatic image forming unit Y, M, C, K is substantially equal to each other because of the effects of the turn-back mirror 228.

Hereinafter, the developing means 223 will be described in detail, taking the monochromatic image forming unit Y as a representative example. In this embodiment, since the respective monochromatic image forming units Y, M, C, and K are arranged obliquely on the left side of the drawing and the toner containers 229 are arranged obliquely downward.

That is, the developing means 223 each comprises the toner container 229 for containing the toner, a toner storage area 230 formed in the toner container 229 (indicated by hatching in the drawing), a toner agitating member 231 disposed inside the toner storage area 230, a partition member 232 defined in an upper portion of the toner storage area 230, a toner supplying roller 233 disposed above the partition member 232, a charging blade 234 attached to the partition member 232 to be brought into contact with the toner supplying roller 233, a development roller 235 arranged to abut both the toner supplying roller 233 and the latent image carrier 220, and a regulating blade 236 arranged to be brought into contact with the development roller 235.

The development roller 235 and the toner supplying roller 233 are rotated in a direction opposite to the rotational direction of the latent image carrier 220 as shown by arrows. On the other hand, the agitating member 231 is rotated in a direction opposite to the rotational direction of the supply roller 233. Toner agitated and scooped up by the agitating member 231 in the toner storage area 230 is supplied to the toner supplying roller 233 along the upper surface of the partition member 232. Friction is caused between the toner supplied and the charging blade 234 made of a flexible material so that mechanical adhesive force and adhesive force by triboelectric charging are created relative to the rough surface of the supply roller 233. By these adhesive forces, the toner is supplied to the surface of the development roller 235.

The toner supplied to the development roller 235 is controlled to a thinned layer having a predetermined thickness by the regulating blade 236. The toner layer as a thinned layer is then delivered to the latent image carrier 220 where an electrostatic latent image thereon is developed at a developing area where the development roller 235 comes close to the latent image carrier 220.

For the formation of images, the paper feeding unit 211 comprises a paper feeding cassette 238 having a stack of recording materials S therein and a pick-up roller 239 for feeding the recording materials S one by one from the paper feeding cassette 238.

The paper delivery unit 212 comprises a pair of gate rollers 240 for controlling the feed timing of feeding a recording material S to the secondary transfer section (with one roller located on the side of the housing 202), a secondary transfer roller 219 as a secondary transfer means in engagement with the driving roller 213 and the intermediate transfer belt 215, a main recording material delivery path 241, a fixing means 242, a pair of ejection rollers 243 and a double-side-printing delivery path 244. Toner residues on the intermediate transfer belt 215 after the transfer to the recording material are removed by a cleaning means 216.

The fixing means 242 comprises a pair of rotatable fixing rollers 245 at least one of which has a built-in heating element such as a halogen heater, and an engaging means that biases at least one roller of the fixing rollers 245 against the other roller thereby engaging the secondary image secondarily transferred to the sheet material with the recording material S. The secondary image secondarily transferred onto the recording material is fixed to the recording material at a nip formed between the pair of the fixing rollers 245 at a predetermined temperature.

Since the intermediate transfer belt 215 is arranged obliquely with respect to the driving roller 213 on the left side of the drawing, a large space is created on the right side thereof. The fixing means 242 can be arranged in the space, thereby achieving the reduction in the size of the image forming apparatus. This arrangement also prevents the heat generated by the fixing means 242 from affecting the exposure unit 207, the intermediate transfer belt 215, and each monochromatic image forming units Y, M, C, K which are located on the left side of the fixing means.

Figure 6A:
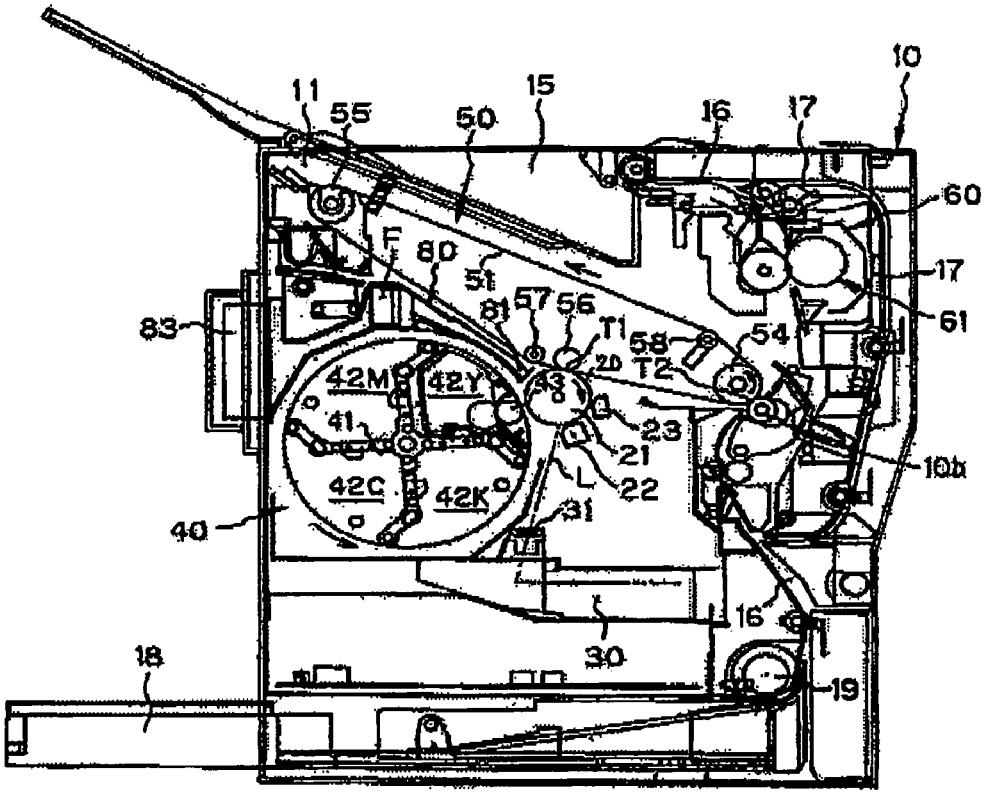
FIG. 6A is an example of a four-cycle type full-color printer according to an image forming apparatus of the invention.
Figure 6B:
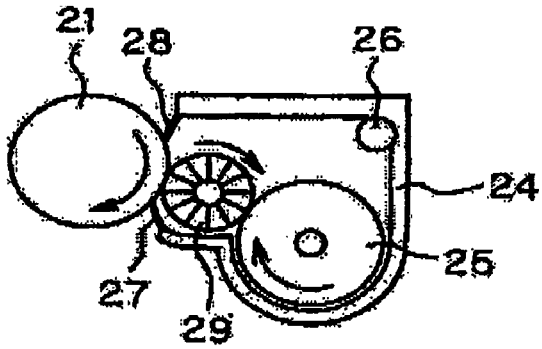
FIG. 6B is an explanatory view illustrating a cleaning means arranged in a latent image carrier.

Next, FIG. 6A is an explanatory view for showing a four-cycle rotary developing type color image forming apparatus of a batch transfer type according to the present invention. The image forming apparatus is capable of forming a full-color image on both faces of the recording material such as a paper and comprises a casing 10 and an image carrier unit 20, an exposure unit 30 serving as an exposing means, a developing unit (developing device) 40 serving as a developing means, an intermediate transfer unit 50, and a fixing unit (fixer) 60 serving as a fixing means, which are housed in the casing 10. The casing 10 has the frame (not shown) of an apparatus main body, to which the units are mounted.

The image carrier unit 20 comprises a latent image carrier (photoreceptor) 21 having a photosensitive layer on the outer circumference and a charging means (scorotron charger) 22 for uniformly charging the outer circumference of the photoreceptor 21. The outer circumference of the photoreceptor 21 which is uniformly charged by the charging means 22 is selectively exposed to laser light L from the exposure unit 30 to form an electrostatic latent image. The electrostatic latent image is provided with a toner acting as a developer by the developing unit 40 into a visible image (toner image). The toner image is primarily transferred to an intermediate transfer belt 51 of the intermediate transfer unit 50 by a primary transfer section T1 and then secondarily transferred to a paper as the subject to be transferred, by a secondary transfer section T2.

The casing 10 comprises a delivery path 16 for delivering the paper having an image on one face formed by the secondary transfer section T2 toward a paper ejecting section (ejection tray) 15 on the top of the casing 10 and a return path 17 for switching back the paper delivered to the paper ejecting section 15 through the delivery path 16 toward the secondary transfer section T2 so as to form an image on the other face. In the lower portion of the casing 10, a paper feeding tray 18 for holding a stack of the paper and a paper feeding roller 19 for feeding the paper toward the secondary transfer section T2 one by one, are arranged.

The developing unit 40 is a rotary developing unit and comprises a plurality of developing unit cartridges each having a toner detachably mounted to the main body of a rotor 41. This embodiment includes a yellow developing unit cartridge 42Y, a magenta developing unit cartridge 42M, a cyan developing unit cartridge 42C, and a black developing unit cartridge 42K (only the yellow developing unit cartridge 42Y is directly illustrated in the drawing) The main body of the rotor 41 is rotated in the direction of the arrow at a pitch of 90° to selectively bring a developing roller 43 into contact with the photoreceptor 21, thereby allowing selective development of the surface of the photoreceptor 21.

The exposure unit 30 emits the laser light L through an exposure window 31 made of plate glass or the like toward the photoreceptor 21.

As shown in FIGS. 6A and (*b*), the cleaning means 23 is disposed opposite to the latent image carrier 21 below the primary transfer roller 56. Within a cleaner casing 24 of the cleaning means, for example, a spiral rotor 25 composed of a spiral member such as a metal panel is arranged. Further, the cleaning means 23 is held by a means 26 which is attached to the cleaner casing 24 and which can be brought into and out of contact with the cleaning means at the time of development. Inside the cleaner casing 24, a lower seal 27 and an upper seal 28 are arranged so as to prevent toner from escaping between the latent image carrier 21 and the cleaner casing.

Toner remaining on the latent image carrier 21 after the development is scraped by a roll brush 29 which is rotated in a counter direction to the latent image carrier 21, is collected in the cleaner casing 24 and is then delivered toward the back of the cleaner casing from the cleaner casing 24 to a waste toner tank (not shown) by means of a helical rotor 25. However, it is difficult to completely remove toner from the cleaner casing 24. The occurrence of intense vibrations in the apparatus such as delivery or the like in the state that the waste toner is remained, causes toner remained in the cleaner to fly high and to scatter in the apparatus. Therefore, it is preferred that a hole for cleaning toner is arranged in the cleaner casing 24 such that the remaining toner is absorbed through the hole.

A roll brush used in the cleaning device can be fabricated by a method in described in JP-A No. 10-293439. A ribbon-type brush body having plural conductive brush hairs pile textured in a base fabric is helically wound onto a mandrel roll made of metal such that the pile textured direction is straight to a long side of the brush body, Such conductive brush hair is formed of a conductive yarn in which a conductive material such as carbon black is dispersed into a base material such as nylon, rayon, vinylon, polyester and acryl. The resistance can be optionally adjusted according to the amount of a conductive carbon material. The thickness of such conductive fiber is preferably 600 D/F, the texture density is preferably 100,000 E/inch$^2$, and the pile length is preferably 6.5 mm. The base fabric is made of warp and weft threads, is composed of polyester synthetic threads having a thickness of preferably 40/2 and is subjected to mat broadloom of W texture using a conductive fiber, thereby obtaining a base fabric composed of a pile texture having the texture direction in the longitudinal direction.

After pile texturing in the base fabric, the back of the base fabric is subjected to a hard coat treatment using a conductive styrene butadiene rubber (SBR). Then, the base fabric is cut to each slit width of preferably 15 mm to form a ribbon-type brush body. The mandrel roll has a shaft diameter of preferably 6 mm and the material thereof is SUM subjected to Kanigen plating. The mandrel roll is wound with a double-sided adhesive tape. Further, the ribbon-type brush body is helically wound onto the double-sided adhesive tape. Then, when the brush roll is subjected to leiotrichous processing, the sintered body of a roll brush having an outer diameter of preferably 15 mm, i.e., a fur brush is prepared.

With respect to the roll brush prepared, various synthetic fibers (manufactured by Toeisangyo Co., Ltd.) are selected as a conductive fiber and each work function was measured. As a result, the work function of nylon UNN was 4.80 eV, that of nylon GBN was 4.93 eV, that of vinylon USV was 4.95 eV, and that of polyester 4KC was 5.70 eV. In the invention, the roll brush 1 of USV having the work function of 4.95 eV and the roll brush 2 of 4KC having the work function of 5.70 eV were used.

The intermediate transfer unit 50 comprises a unit frame (not shown), a driving roller 54 rotatably supported by the frame, a driven roller 55, a primary transfer roller 56, a guide roller 57 for stabilizing the state of the intermediate transfer belt 51 in the primary transfer section T1, a tension roller 58, and the intermediate transfer belt 51 stretched around the rollers. The intermediate transfer belt 51 is driven to circulate in the direction of the arrow.

The primary transfer section T1 is formed between the photoreceptor 21 and the primary transfer roller 56. The secondary transfer section T2 is formed at the pressure contact part between the driving roller 54 and a secondary transfer roller 10*b* provided adjacent to the main body.

The secondary transfer roller 10*b* can be brought into and out of contact with the driving roller 54 (accordingly, the intermediate transfer belt 51) and when it comes in contact, the secondary transfer section T2 is formed.

Accordingly, in order to form a color image, multi-color toner images are superposed on the intermediate transfer belt 51 with the secondary transfer roller 10*b* separated from the intermediate transfer belt 51 to form a color image. The secondary transfer roller 10*b* is then brought into contact with the intermediate transfer belt 51 and a paper is fed to the contact part (secondary transfer section T2), so that the color image (toner image) is transferred onto the paper.

The paper on which the toner image is transferred passes through a pair of heating rollers 61 of the fixing unit 60 to have the toner image fixed by melting and is then ejected toward the paper ejecting section 15. The fixing unit 60 is an oilless fixing unit that applies no oil to the heating rollers 61.

The toner prepared according to the invention can be a toner which is suitably applied to any one of an image forming apparatus using the monocomponent toner as described in detail in JP 2002-202622 A, an image forming apparatus using a two-component toner, an image forming apparatus using a contact developing method and an image forming apparatus using a non-contact developing method. In particular, it can be a toner which is suitably applied to an image forming apparatus using a non-contact developing method.

EXAMPLES

The present invention is now illustrated in greater detail with reference to Examples and Comparative Examples, but it should be understood that the present invention is not to be construed as being limited thereto.

Example 1A

Based on 100 parts by weight of cyan toner mother particles produced in Preparative Example 1A of the above-described toner mother particles and 0.5 part by weight of the respective alumina fine particles of Table 3 were mixed and stirred respectively using a blender (available from WARING PRODUCTS INC.) for 1 minute. Thereafter, accumulated percent of particles with a particle size in the range of 3.00 μm or less based on entity number was measured using a flow-type particle image analyzing device (FPIA2100, available from SYSMEX CORPORATION). The respective results are presented in Table 4.

TABLE 4

| Alumina fine particles | Accumulated percent of 3.00 μm or less | Difference between work functions of toner mother particles and alumina fine particles |
|---|---|---|
| α-type alumina 1 | 1.58 | 0.42 |
| α-type alumina 2 | 3.59 | 0.28 |
| α-type alumina 3 | 9.49 | 0.19 |
| α-type alumina 4 | 10.06 | 0.17 |
| α-type alumina 5 | 19.08 | 0.12 |

Conventionally, when the amount of an external additive liberated from toner mother particles was large, it gave an influence on powder characteristics or charging properties, and particularly, when a continuous printing was performed, a behavior of the toner was changed in a discontinuous manner. Therefore, it can be shown that the image quality (image density, color reproducibility, etc.) to be obtained became uneven, and thus had disadvantages in a color image.

As shown from the results of Table 4, when the difference between work functions of toner mother particles and alumina fine particles was small, it was easy for the alumina fine particles to be liberated from the surface of the cyan toner mother particle, while, when the difference between the respective work functions was large, it was difficult to be liberated. When the difference between work functions of toner mother particles and alumina fine particles was 0.4 eV or more, it can be shown that the α-type alumina fine particles was hardly liberated from the toner mother particle.

Example 2A

Based on 100 parts by weight of yellow toner mother particles produced in Preparative Example 3A of the above-described toner mother particles, 0.5 part by weight of α-type alumina 2 (number average particle size of 0.23 μm) and 0.5 part by weight of α-type alumina 4 (number average particle size of 0.10 μm) of Table 3 were mixed and stirred respectively using a blender (available from WARING PRODUCTS INC.) for 1 minute. Thereafter, accumulated percent of particles with a particle size in the range of 3.00 μm or less based on the number of particles was measured using a flow-type particle image analyzing device (FPIA2100, available from SYSMEX CORPORATION). The respective results are presented in Table 5.

TABLE 5

| Alumina fine particles | Accumulated percent of 3.00 μm or less | Work function of toner mother particles and alumina fine particles |
|---|---|---|
| α-type alumina 2 | 1.25 | 0.63 |
| α-type alumina 4 | 1.01 | 0.52 |

With respect to using a yellow toner mother particle, it can be shown that the same results were also given as in Example 1A.

Example 3A

Production examples of the respective members in a color image forming apparatus illustrated in FIG. 5 and FIG. 6 of the invention will be described.

Production of Organic Photoreceptor

On a conductive support of an aluminum pipe with a diameter of 30 mm, a coating solution obtained by dissolving and dispersing 6 parts by weight of alcohol dissolvable nylon (CM8000, available from Toray Industries, Inc.) and 4 parts by weight of titanium oxide fine particles treated with aminosilane in 100 parts by weight of methanol was coated as an undercoat layer by a ring coating method. The coated layer was dried at the temperature of 100° C. for 40 minutes to form an undercoat layer of 1.5 to 2 μm in film thickness.

On this undercoat layer, a pigment dispersed liquid obtained by dispersing 1 part by weight of an oxytitanyl phthalocyanine pigment as a charge generation pigment, 1 part by weight of a butyral resin (BX-1, available from Sekisui Chemical Co., Ltd.), and 100 parts by weight of dichloroethane for 8 hours using a sand mill with glass beads of ϕ1 mm was coated by a ring coating method. The coated layer was dried at 80° C. for 20 minutes to form a charge generation layer of 0.3 μm in film thickness.

On this charge generation layer, a liquid obtained by dissolving 40 parts by weight of charge transport material of a styryl compound having the following structural formula (1) and 60 parts by weight of a polycarbonate resin (PANLITE TS, available from TEIJIN CHEMICALS LTD.) in 400 parts by weight of toluene was coated by a dip coating method to have the film thickness of 22 μm when dried and then dried, thereby forming a charge transport layer. In this manner, an organic photoreceptor having two layers was produced.

(1)

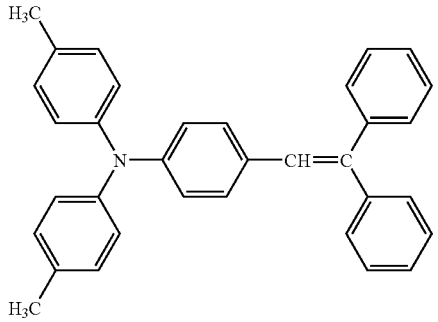

A test piece was made by cutting a part of the obtained organic photoreceptor, and a work function was measured by using a surface analyzer (AC-2 type, available from Riken Keiki Co., Ltd.) with radiation amount of 500 nW. As a result, a work function was 5.47 eV.

Production Example of Developing Roller

Nickel plating (thickness of 10 μm) was carried out on the surface of an aluminum pipe of 18 mm in diameter, and the surface roughness (Rz) was 4 μm. A work function of the developing roller was measured under the same conditions and was resulted 4.58 eV.

Production Example OF Regulating Blade

A conductive urethane rubber tip of 1.5 mm in thickness was attached on a SUS plate of 80 μm in thickness by a conductive adhesive. Under the same condition, a work function of a urethane rubber surface was 5 eV.

Production Example of Intermediate Transfer Belt 1A 85 parts by weight of polybutylene terephthalate, 15 parts by weight of polycarbonate and 15 parts by weight of acetylene black was premixed in a mixer under a nitrogen atmosphere. The obtained mixture was kneaded with a twin-screw extruder continuously under nitrogen gas atmosphere to obtain a pellet. This pellet was then extruded through a single-screw extruder having an annular die at 260° C. into a tubular film having an outer diameter of 170 mm and a thickness of 160 μm. The inner diameter of the extruded molten tube was then controlled by a cooling inside mandrel supported on the same axis as the annular die, after which the tube was cooled and solidified to produce a seamless tube, which was in turn cut to the predetermined size, thereby obtaining a seamless belt having an outer diameter of 172 mm, a width of 342 mm and a thickness of 150 μm. This transfer belt had a volume resistance of $3.2\times10^{8}$ Ω·cm, a work function measured under same condition of 5.19 eV and a normalized photoelectron yield of 10.88.

Production of Toner Particle

The respective toner mother particles obtained in Preparative Examples 1 to 4 was weighed to the amount of 100 parts by weight, respectively. Based on each toner mother particles, 0.5% by weight of hydrophobic silica having a number average particle size of about 12 nm as a flowability improver, 0.5% by weight of hydrophobic silica having a number average particle size of about 40 nm, 0.5% by weight of hydrophobic titanium oxide having a number average particle size of about 20 nm and 0.3% by weight of α-type alumina 1 in Table 3 were subjected to external addition using a laboratory mixer at 10,000 rpm for 1 minute. Then, 0.3% by weight of hydrophobic positively-chargeable silica having a number average particle size of 30 nm and 0.1% by weight of metallic soap particles listed in the following Table 6 combined with the color of the respective toner mother particles were added thereto and subjected to external addition at 10,000 rpm for 1 minute, thereby producing toners for evaluation, respectively.

Further, each toner for evaluation was produced in the same manner as above, except that α-type alumina 3 of Table 3 was used instead of α-type alumina 1.

TABLE 6

| Preparative Example No. of toner mother particle | Added metallic soap |
|---|---|
| 1 (Cyan toner) | Zinc stearate |
| 2 (Magenta toner) | Magnesium stearate |
| 3 (Yellow toner) | Magnesium stearate |
| 4 (Black toner) | Zinc stearate |

A developing unit having the above-obtained toners for evaluation was set in a tandem color image forming apparatus with cleanerless type latent image carrier by a non-magnetic monocomponent non-contact developing type shown in FIG. 5. Setting order, seen from the lower side where paper is provided, was in the order of a cyan developing unit, a magenta developing unit, a yellow developing unit and a black developing unit.

In the following Table 7, the number of + toner (%) and an average quantity of charges (−μc/g) on the toner, that was measured of the charging properties of the toner on the developing roller using a charge quantity distribution analyzer (E-SPART Analyzer EST-3 Typel made by Hosokawa Micron Co., Ltd.) at initial and after printing 20,000 sheets of a textual document corresponding to 5% color document for each color, are presented.

TABLE 7

| | | Initial | | After continuous printing | |
|---|---|---|---|---|---|
| | Toner | Average quantity of charges | Number of + toner (%) | Average quantity of charges | Number of + toner (%) |
| Ex. | Cyan toner | −10.31 | 2.1 | −10.01 | 5.6 |
| | Magenta toner | −11.69 | 1.9 | −10.73 | 4.3 |
| | Yellow toner | −10.05 | 2.9 | −11.63 | 6.1 |
| | Back toner | −9.98 | 2.8 | −8.99 | 7.1 |
| Comp. Ex. | Cyan toner | −10.00 | 2.6 | −9.11 | 8.3 |
| | Magenta toner | −11.31 | 2.1 | −10.31 | 8.0 |
| | Yellow toner | −10.83 | 2.8 | −9.60 | 8.4 |
| | Back toner | −9.39 | 4.0 | −8.11 | 9.6 |

According to the results of Table 7, it can be shown that in the case of toners with the respective colors of the invention using α-type alumina 1, the difference between a work function ($\Phi_t$)of toner mother particles and a work function ($\Phi_A$) of α-type alumina fine particles was 0.4 eV or more in any one of the toners, and increase in the amount of + toner after continuous printing could be inhibited. Meanwhile, in the case of toners with the respective colors for comparative use using α-type alumina 3 of the comparative example, the difference between a work function ($\Phi_t$) of toner mother particles and a work function ($\Phi_A$) of α-type alumina fine particles was small, and it was known that there was tendency to increase the amount of + toner which is reverse polarity to a toner having reduced drop of an average quantity of charges.

In addition, an N-2A "cafeteria" image according to standard image data in compliance with JIS X9201-1995 was output at initial and after 20,000 sheets of printing a 5% document. Then, the color reproducibility of a first sheet and 20,001$^{st}$ sheet was evaluated, and the results are presented in the following Table 8. With respect to the color reproducibility, by setting the image quality of the first sheet on the bases of 10 point rating, the image quality of 20,001$^{st}$ sheet was evaluated subjectively.

TABLE 8

| | | Color reproducibility | |
|---|---|---|---|
| | | First sheet | 20,001th sheet |
| Example | Cyan toner<br>Magenta toner<br>Yellow toner<br>Back toner | 10 | 8 |
| Comparative Example | Cyan toner<br>Magenta toner<br>Yellow toner<br>Back toner | 10 | 6 |

Example 4A

Toners with the respective colors of the invention was produced in the same matter as in Example 3A, except that as for each toner mother particles obtained in Preparative Examples 5 to 8, α-type alumina 1 was used with respect to cyan toner mother particles 5 and α-type alumina 2 was used with respect to other three colors of toner mother particles, and that a combination of metallic soap added in toner mother particles was as in the following Table 9.

Further, toners with the respective colors were produced in the same manner as above for comparative use, except that 0.3% by weight of α-type alumina 3 was used instead of α-type alumina 1 and 2.

TABLE 9

| Preparative Example No. of toner mother particle | Added metallic soap |
|---|---|
| 5 (Cyan toner) | Calcium stearate |
| 6 (Magenta toner) | Magnesium stearate |
| 7 (Yellow toner) | Magnesium stearate |
| 8 (Black toner) | Zinc stearate |

A developing unit equipped with the above-obtained each toner was set in a full-color printer with four-cycle rotary type having a brush cleaning means on a latent image carrier by a non-magnetic monocomponent non-contact developing type as shown in FIG. 6. Setting order was such that development/transfer was carried out from the toner having large work function of toner mother particles; namely, in the order of cyan, magenta, yellow and black. Image treatment was also controlled such that it was carried out in the above order.

Method for evaluation was carried out by measuring the total cleaning amount of a latent image carrier and an intermediate transfer belt after 20,000 sheets of printing a textual document corresponding to 5% color document for each color. Further, an N-2A "cafeteria" image according to standard image data in compliance with JIS X9201-1995 was output at initial and after 20,000 sheets of printing a 5% document. Then, the color reproducibility of a first sheet and 20,001$^{st}$ sheet was evaluated, and the results are presented. These results together with the total cleaning amount are presented in Table 10. Further, with respect to the color reproducibility, by setting the image quality of the first sheet on the bases of 10 point rating, the image quality of 20,001$^{st}$ sheet was evaluated subjectively.

TABLE 10

| | Total cleaning amount (g) | Color reproducibility | |
|---|---|---|---|
| | | First sheet | 20,001st sheet |
| Toner of present invention | 31 | 10 | 10 |
| Toner of comparative use | 91 | 10 | 7 |

As apparent from Table 10, when the "cafeteria" image was observed using the toner of comparative use compared with the case of using each color toner of the invention, in the comparison of the first sheet and the 20,001st sheet, the entire chroma was lowered, and a grave image was given. Meanwhile, in the case of using each color toner of the invention, lowering of the quality of the color image could not be seen. Also, the total cleaning amount of the invention was about ⅓ that of the toner for comparative use, and it can be confirmed that the charging property and powder property of the toner of the invention were stable compared with the toner for comparative use.

Example 1B

Using the cyan toner mother particles 1 prepared in the production example 1 of the toner mother particles, 3.0 kg of the cyan toner mother particles 1 were charged in a spherical mixing tank (blade-type turbine, Q type 20 L, manufactured by Mitsui Mining Co., Ltd.) Then, 15 g of the silica fine particles ("RX200" manufactured by Nippon Aerosil Co., Ltd.; a number average particle size of 12 nm) and 15 g of the silica fine particles ("RX50" manufactured by Nippon Aerosil Co., Ltd.; a number average particle size of 40 nm) were added thereto.

The spherical mixing tank has an inner volume of 20 L. The length inside the container of the cylinder-shaped member 107 is 1/11 of the height from the donut-shaped disc 104 inside container, and a ratio of the diameter of the bottom of horizontal disc-shaped processing tank 2 to the diameter of the mixing processing tank 101 is 0.57. A ratio of the external diameter of the donut-shaped disc 104 to the diameter of the bottom of horizontal disc-shaped processing tank 2 is 1.10. A ratio of the diameter of the stirring blade (turbine blade) 5 to the diameter of the mixing processing tank 101 is 0.75, and a ratio of the internal diameter to the external diameter of the donut-shaped disc 104 is 0.73. In the spherical mixing tank, the mixing processing was conducted for 2 minutes at a peripheral velocity of the turbine blade of 50 m/s with an amount of sealing air of 1.0 $Nm^3/h$.

After stopping the mixing, the second step in externally adding treatment was conducted as follows. 15 g of the titanium oxide fine particles ("STT-30S" manufactured by Titan Kogyo K.K.; a number average particle size of 3.0 nm) and 6 g of the α-type alumina 1 ("AKP-53" manufactured by Sumitomo Chemical Co., Ltd.; a number average particle size of 0.21 μm) were added thereto, followed by subjecting to the mixing processing for 2 minutes at a peripheral velocity of the turbine blade of 50 m/s with an amount of sealing air of 1.0 $Nm^3/h$.

After stopping the mixing, the third step in externally adding treatment was conducted as follows. 3 g of the zinc stearate particles ("MZ2" manufactured by NOF Corporation; a number average particle size of 0.9 μm) and 3 g of the positively-charged silica particles ("NA50H" manufactured by Nippon Aerosil Co., Ltd.; a number average particle size of 30 nm) were added thereto, followed by subjecting to the mixing processing for 2 minutes at a peripheral velocity of the turbine blade of 50 m/s with an amount of sealing air of 1.0 $Nm^3/h$ to obtain a toner.

Further, the work function ($\Phi_t$) of the toner mother particles—the work function ($\Phi_A$) of the α-type alumina fine particles (hereinafter, referred to as the difference of the work function) is 0.42.

The amount of the fine particles in the toner of 3 μm or less was measured by a flow type particle image analyzer ("FPIA2100" manufactured by Sysmex Corporation). The result thereof is shown in Table 11.

Next, the resulting toner was charged in a toner cartridge for a color printer ("LP7000C" manufactured by Seiko Epson Corporation), and then A3 solid image printing was performed. Uniformity of the amount of the toner to be transported was estimated from concentration irregularity on the paper.

Further, the scratches on the surfaces of the developing roller, and the latent image carrier (organic photosensitive layer) after 3,000 sheets were printed by 5% printing were observed. The result thereof is also shown in Table 11. "A" represents the case in which there are no scratches, "B" represents the case in which scratches are recognized but not shown in images, and a symbol "C" represents the case in which scratches are shown in images, Example 2B Using the cyan toner mother particles 2 prepared in the production example 5 of the toner mother particles, 3.0 kg of the cyan toner mother particles 2 were charged in the same spherical mixing tank as in Example 1B. Then, 15 g of the silica fine particles ("RX200" manufactured by Nippon Aerosil Co., Ltd.; a number average particle size of 12 nm) and 6 g of the α-type alumina 1 ("AKP-53" manufactured by Sumitomo Chemical Co., Ltd.; a number average particle size of 0.21 μm) were added thereto, followed by subjecting to the mixing processing for 2 minutes at a peripheral velocity of the turbine blade of 48 m/s with an amount of sealing air of 1.0 $Nm^3/h$.

After stopping the mixing, the second step in externally adding treatment was conducted as follows. 15 g of the silica fine particles ("RX50" manufactured by Nippon Aerosil Co., Ltd.; a number average particle size of 40 nm) and 15 g of the titanium oxide fine particles ("STT-30S" manufactured by Titan Kogyo K.K.; a number average particle size of 30 nm) were added thereto, followed by subjecting to the mixing processing for 2 minutes at a peripheral velocity of the turbine blade of 48 m/s with an amount of sealing air of 1.0 $Nm^3/h$.

After stopping the mixing, the third step in externally adding treatment was conducted as follows. 3 g of the magnesium stearate particles ("MM-2" manufactured by NOF Corporation; a number average particle size of 1.9 μm) was added thereto, followed by subjecting to the mixing processing for 2 minutes at a peripheral velocity of the turbine blade of 48 m/s with an amount of sealing air of 1.0 $Nm^3/h$ to obtain a toner.

In addition, the difference between the work functions is 0.41.

Similarly to Example 1B, the amount of the fine particles in the toner of 3 μm or less, the uniformity of the amount of the toner to be transported, and the scratches on the surfaces of the developing roller and the latent image carrier (organic photosensitive layer) after 3,000 sheets was printed by 5% printing were observed. The result thereof is also shown in Table 11.

Example 3B

Using the magenta toner mother particles 1 prepared in the production example 2 of the toner mother particles, 3.0 kg of the magenta toner mother particles 1 were charged in the same spherical mixing tank as in Example 1B. Then, 15 g of the silica fine particles ("$RX_{200}$" manufactured by Nippon Aerosil Co., Ltd.; a number average particle size of 12 nm), 15 g of the silica fine particles ("RX50" manufactured by Nippon Aerosil Co., Ltd.; a number average particle size of 40 nm) and 6 g of the α-type alumina 1 ("AKP-53" manufactured by Sumitomo Chemical Co., Ltd.; a number average particle size of 0.21 μm) were added thereto, followed by subjecting to the mixing processing for 2 minutes at a peripheral velocity of the turbine blade of 52 m/s with an amount of sealing air of 1.0 $Nm^3/h$.

After stopping the mixing, the second step in externally adding treatment was conducted as follows. 15 g of the titanium oxide fine particles ("STT-30S" manufactured by Titan Kogyo K.K.; a number average particle size of 30 nm) were added thereto, followed by subjecting to the mixing processing for 2 minutes at a peripheral velocity of the turbine blade of 52 m/s with an amount of sealing air of 1.0 $Nm^3/h$.

After stopping the mixing, the third step in externally adding treatment was conducted as follows. 3 g of the calcium stearate particles ("MC-2" manufactured by NOF Corporation; a number average particle size of 1.1 μm) was added thereto, followed by subjecting to the mixing processing for 2 minutes at a peripheral velocity of the turbine blade of 52 m/s with an amount of sealing air of 1.0 $Nm^3/h$ to obtain a toner.

In addition, the difference between the work functions is 0.68.

Similarly to Example 1B, the amount of the fine particles in the toner of 3 μm or less, the uniformity of the amount of the toner to be transported, and the scratches on the surfaces of the developing roller and the latent image carrier (organic photosensitive layer) after 3,000 sheets was printed by 5% printing were observed. The result thereof is also shown in Table 11.

Example 4B

Using the magenta toner mother particles 2 prepared in the production example 6 of the toner mother particles, 3.0 kg of the magenta toner mother particles 2 were charged in the same spherical mixing tank as in Example 1B. Then, 15 g of the silica fine particles ("RX200" manufactured by Nippon Aerosil Co., Ltd.; a number average particle size of 12 nm) and 6 g of the α-type alumina 1 ("AKP-53" manufactured by Sumitomo Chemical Co., Ltd.; a number average particle size of 0.21 μm) were added thereto, followed by subjecting to the mixing processing for 2 minutes at a peripheral velocity of the turbine blade of 52 m/s with an amount of sealing air of 1.0 $Nm^3/h$.

After stopping the mixing, the second step in externally adding treatment was conducted as follows. 15 g of the silica fine particles ("RX50" manufactured by Nippon Aerosil Co., Ltd.; a number average particle size of 40 μm) and 15 g of the titanium oxide fine particles ("STT-30S" manufactured by Titan Kogyo K.K.; a number average particle size of 30 nm) were added thereto, followed by subjecting to the mixing processing for 2 minutes at a peripheral velocity of the turbine blade of 52 m/s with an amount of sealing air of 1.0 $Nm^3/h$.

After stopping the mixing, the third step in externally adding treatment was conducted as follows 3 g of the magnesium stearate particles ("MM-2" manufactured by NOF Corporation; a number average particle size of 1.9 μm) and 3 g of the positively-charged silica particles ("NA50H" manufactured by Nippon Aerosil Co., Ltd.; a number average particle size of 30 nm) were added thereto, followed by subjecting to the mixing processing for 2 minutes at a peripheral velocity of the turbine blade of 52 m/s with an amount of sealing air of 1.0 $Nm^3/h$ to obtain a toner.

In addition, the difference between the work functions is 0.59.

Similarly to Example 1B, the amount of the fine particles in the toner of 3 μm or less, the uniformity of the amount of the toner to be transported, and the scratches on the surfaces of the developing roller and the latent image carrier (organic photosensitive layer) after 3,000 sheets was printed by 5% printing were observed. The result thereof is also shown in Table 11.

Example 5B

Using the yellow toner mother particles 1 prepared in the production example 3 of the toner mother particles, 3.0 kg of the yellow toner mother particles 1 were charged in the same spherical mixing tank as in Example 1B. Then, 15 g of the silica fine particles ("RX200" manufactured by Nippon Aerosil Co., Ltd.; a number average particle size of 12 nm) and 15 g of the silica fine particles ("RX50" manufactured by Nippon Aerosil Co., Ltd.,; a number average particle size of 40 μm) were added thereto, followed by subjecting to the mixing processing for 2 minutes at a peripheral velocity of the turbine blade of 55 m/s with an amount of sealing air of 1.0 $Nm^3/h$.

After stopping the mixing, the second step in externally adding treatment was conducted as follows. 6 g of the α-type alumina 1 ("AKP-53" manufactured by Sumitomo Chemical Co., Ltd.; a number average particle size of 0.21 μm) and 15 g of the titanium oxide fine particles ("STT-30S" manufactured by Titan Kogyo K.K.; a number average particle size of 30 nm) were added thereto, followed by subjecting to the mixing processing for 2 minutes at a peripheral velocity of the turbine blade of 55 m/s with an amount of sealing air of 1.0 $Nm^3/h$.

After stopping the mixing, the third step in externally adding treatment was conducted as follows. 3 g of the magnesium stearate particles ("MM-2" manufactured by NOF Corporation; a number average particle size of 1.9 μm) and 3 g of the positively-charged silica particles ("NA50H" manufactured by Nippon Aerosil Co., Ltd.; a number average particle size of 30 nm) were added thereto, followed by subjecting to the mixing processing for 2 minutes at a peripheral velocity of the turbine blade of 55 =/s with an amount of sealing air of 1.0 $Nm^3/h$ to obtain a toner.

In addition, the difference between the work functions is 0.68.

Similarly to Example 1B, the amount of the fine particles in the toner of 3 μm or less, the uniformity of the amount of the toner to be transported, and the scratches on the surfaces of the developing roller and the latent image carrier (organic photosensitive layer) after 3,000 sheets was printed by 5% printing were observed. The result thereof is also shown in Table 11.

Example 6B

Using the yellow toner mother particles 2 prepared in the production example 7 of the toner mother particles, 3.0 kg of the yellow toner mother particles 2 were charged in the same spherical mixing tank as in Example 1B. Then, 15 g of the silica fine particles ("$RX_{200}$" manufactured by Nippon Aerosil Co., Ltd.; a number average particle size of 12 nm) and 15 g of the silica fine particles ("RX50" manufactured by Nippon Aerosil Co., Ltd.; a number average particle size of 40 nm) were added thereto, followed by-subjecting to the mixing processing for 2 minutes at a peripheral velocity of the turbine blade of 48 m/s with an amount of sealing air of 1.0 $Nm^3/h$, After stopping the mixing, the second step in externally adding treatment was conducted as follows. 6 g of the α-type alumina 1 ("AKP-53" manufactured by Sumitomo Chemical Co., Ltd.; a number average particle size of 0.21 μm) and 15 g of the titanium oxide fine particles ("STT-30S" manufactured by Titan Kogyo K.K.; a number average particle size of 30 nm) were added thereto, followed by subjecting to the mixing processing for 2 minutes at a peripheral velocity of the turbine blade of 48 m/s with an amount of sealing air of 1.0 $Nm^3/h$.

After stopping the mixing, the third step in externally adding treatment was conducted as follows. 3 g of the zinc stearate particles ("MZ2" manufactured by NOF Corporation; a number average particle size of 0.9 μm) and 3 g of the positively-charged silica particles ("NA50H" manufactured by Nippon Aerosil Co., Ltd.; a number average particle size of 30 nm) were added thereto, followed by subjecting to the mixing processing for 2 minutes at a peripheral velocity of the turbine blade of 48 m/s with an amount of sealing air of 1.0 $Nm^3/h$ to obtain a toner.

In addition, the difference between the work functions is 0.66.

Similarly to Example 1B, the amount of the fine particles in the toner of 3 μm or less, the uniformity of the amount of the toner to be transported, and the scratches on the surfaces of the developing roller and the latent image carrier (organic photosensitive layer) after 3,000 sheets was printed by 5% printing were observed. The result thereof is also shown in Table 11.

Example 7B

Using the black toner mother particles 1 prepared in the production example 4 of the toner mother particles, 3.0 kg of the black toner mother particles 1 were charged in the same spherical mixing tank as in Example 1B. Then, 15 g of the silica fine particles ("RX200" manufactured by Nippon Aerosil Co., Ltd.; a number average particle size of 12 nm) and 6 g of the α-type alumina 1 ("AKP-53" manufactured by Sumitomo Chemical Co., Ltd.; a number average particle size of 0.21 μm) were added thereto, followed by subjecting to the mixing processing for 2 minutes at a peripheral velocity of the turbine blade of 50 m/s with an amount of sealing air of 1.0 $Nm^3/h$.

After stopping the mixing, the second step in externally adding treatment was conducted as follows. 15 g of the silica fine particles ("RX50" manufactured by Nippon Aerosil Co., Ltd.; a number average particle size of 40 nm) and 15 g of the titanium oxide fine particles ("STT-30S" manufactured by Titan Kogyo K.K.; a number average particle size of 30 nm) were added thereto, followed by subjecting to the mixing processing for 2 minutes at a peripheral velocity of the turbine blade of 50 m/s with an amount of sealing air of 1.0 $Nm^3/h$.

After stopping the mixing, the third step in externally adding treatment was conducted as follows. 3 g of the magnesium stearate particles ("MM-2" manufactured by NOF Corporation; a number average particle size of 1.9 μm) and 3 g of the positively-charged silica particles ("NA50H" manufactured by Nippon Aerosil Co., Ltd.; a number average particle size of 30 nm) were added thereto, followed by subjecting to the mixing processing for 2 minutes at a peripheral velocity of the turbine blade of 50 m/s with an amount of sealing air of 1.0 $Nm^3/h$ to obtain a toner.

In addition, the difference between the work functions is 0.51.

Similarly to Example 1B, the amount of the fine particles in the toner of 3 μm or less, the uniformity of the amount of the toner to be transported, and the scratches on the surfaces of the developing roller and the latent image carrier (organic photosensitive layer) after 3,000 sheets was printed by 5% printing were observed. The result thereof is also shown in Table 11.

Example 8B

Using the black toner mother particles 2 prepared in the production example 8 of the toner mother particles, 3.0 kg of the black toner mother particles 2 were charged in the same spherical mixing tank as in Example 1B. Then, 15 g of the silica fine particles ("RX200" manufactured by Nippon Aerosil Co., Ltd.; a number average particle size of 12 nm) and 15 g of the silica fine particles ("RX50" manufactured by Nippon Aerosil Co., Ltd.; a number average particle size of 40 nm) were added thereto, followed by subjecting to the mixing processing for 2 minutes at a peripheral velocity of the turbine blade of 45 m/s with an amount of sealing air of 1.0 $Nm^3/h$.

After stopping the mixing, the second step in externally adding treatment was conducted as follows. 6 g of the α-type alumina 1 ("AKP-53" manufactured by Sumitomo Chemical Co., Ltd.; a number average particle size of 0.21 μm) and 15 g of the titanium oxide fine particles ("STT-30S" manufactured by Titan Kogyo K.K.; a number average particle size of 30 nm) were added thereto, followed by subjecting-to the mixing processing for 2 minutes at a peripheral velocity of the turbine blade of 45 m/s with an amount of sealing air of 1.0 $Nm^3/h$.

After stopping the mixing, the third step in externally adding treatment was conducted as follows. 3 g of the zinc stearate particles ("MZ2" manufactured by NOF Corporation; a number average particle size of 0.9 μm) and 3 g of the positively-charged silica particles ("NA50H" manufactured by Nippon Aerosil Co., Ltd.; a number average particle size of 30 μm) were added thereto, followed by subjecting to the mixing processing for 2 minutes at a peripheral velocity of the turbine blade of 45 m/s with an amount of sealing air of 1.0 $Nm^3/h$ to obtain a toner.

In addition, the difference between the work functions is 0.53.

Similarly to Example 1B, the amount of the fine particles in the toner of 3 μm or less, the uniformity of the amount of the toner to be transported, and the scratches on the surfaces of the developing roller and the latent image carrier (organic photosensitive layer) after 3,000 sheets was printed by 5% printing were observed. The result thereof is also shown in Table 11.

Comparative Example 1B

Using the cyan toner mother particles 2 prepared in the production example 5 of the toner mother particles, 3.0 kg of the cyan toner mother particles 2 were charged in the same spherical mixing tank as in Example 1B. Then, 15 g of the silica fine particles ("RX200" manufactured by Nippon Aerosil Co., Ltd.; a number average particle size of 12 ma), 15 g of the silica fine particles ("RX50" manufactured by Nippon Aerosil Co., Ltd.; a number average particle size of 40 m), 15 g of the titanium oxide fine particles ("STT-30S" manufactured by Titan Kogyo K.K.; a number average particle size of 30 μm), 6 g of the α-type alumina 2 ("AKP-50" manufactured by Sumitomo Chemical Co., Ltd.; a number average particle size of 0.23 μm), 3 g of the zinc stearate particles ("MZ2" manufactured by NOF Corporation; a number average particle size of 0.9 μm) and 3 g of the positively-charged silica particles ("NA50H" manufactured by Nippon Aerosil Co., Ltd.; a number average particle size of 30 μm) were added thereto, followed by subjecting to the mixing processing for 2 minutes at a peripheral velocity of the turbine blade of 50 m/s with an amount of sealing air of 1.0 $Nm^3/h$ to obtain a toner.

In addition, the difference between the work functions is 0.27.

Similarly to Example 1B, the amount of the fine particles in the toner of 3 μm or less, the uniformity of the amount of the toner to be transported, and the scratches on the surfaces of the developing roller and the latent image carrier (organic photosensitive layer) after 3,000 sheets was printed by 5% printing were observed. The result thereof is also shown in Table 11.

Comparative Example 2B

Using the cyan toner mother particles 2 prepared in the production example 5 of the toner mother particles, 3.0 kg of the cyan toner mother particles 2 were charged in the same spherical mixing tank as in Example 1B. Then, 3 g of the magnesium stearate particles ("MM-2" manufactured by NOF Corporation; a number average particle size of 1.9 μm) and 3 g of the positively-charged silica particles ("NA50H" manufactured by Nippon Aerosil Co., Ltd.; a number average particle size of 30 nm) were added thereto, followed by subjecting to the mixing processing for 2 minutes at a peripheral velocity of the turbine blade of 55 m/s with an amount of sealing air of 1.0 $Nm^3/h$.

After stopping the mixing, the second step in externally adding treatment was conducted as follows. 15 g of the titanium oxide fine particles ("STT-30S" manufactured by Titan Kogyo K.K.; a number average particle size of 30 nm) and 6 g of the α-type alumina 3 ("LS-235" manufactured by Nippon Light Metal Co., Ltd.; a number average particle size of 0.45 μm) were added thereto, followed by subjecting to the mixing processing for 2 minutes at a peripheral velocity of the turbine blade of 55 m/s with an amount of sealing air of 1.0 $Nm^3/h$.

After stopping the mixing, the third step in externally adding treatment was conducted as follows. 15 g of the silica fine particles ("RX200" manufactured by Nippon Aerosil Co., Ltd.; a number average particle size of 12 nm) and 15 g of the silica fine particles ("RX50" manufactured by Nippon Aerosil Co., Ltd.; a number average particle size of 40 nm) were added thereto, followed by subjecting to the mixing processing for 2 minutes at a peripheral velocity of the turbine blade of 55 m/s with an amount of sealing air of 1.0 $Nm^3/h$ to obtain a toner.

In addition; the difference between the work functions is 0.18.

Similarly to Example 1B, the amount of the fine particles in the toner of 3 μm or less, the uniformity of the amount of the toner to be transported, and the scratches on the surfaces of the developing roller and the latent image carrier (organic photosensitive layer) after 3,000 sheets was printed by 5% printing were observed. The result thereof is also shown in Table 11.

Comparative Example 3B

Using the cyan toner mother particles 2 prepared in the production example 5 of the toner mother particles, 3.0 kg of the cyan toner mother particles 2 were charged in the same spherical mixing tank as in Example 1B. Then, 15 g of the silica fine particles ("RX200" manufactured by Nippon Aerosil Co., Ltd.; a number average particle size of 12 nm) and 15 g of the silica fine particles ("RX50" manufactured by Nippon Aerosil Co., Ltd.; a number average particle size of 40 nm) were added thereto, followed by subjecting to the mixing processing for 2 minutes at a peripheral velocity of the turbine blade of 60 m/s with an amount of sealing air of 1.0 $Nm^3/h$.

After stopping the mixing, the second step in externally adding treatment was conducted as follows. 15 g of the titanium oxide fine particles ("STT-30S" manufactured by Titan Kogyo K.K.; a number average particle size of 30 nm) and 6 g of the α-type alumina 4 ("TD-M" manufactured by TAIMEI Chemicals Co., Ltd.; a number average particle size of 0.70 μm) were added thereto, followed by subjecting to the mixing processing for 2 minutes at a peripheral velocity of the turbine blade of 55 m/s with an amount of sealing air of 1.0 $Nm^3/h$.

After stopping the mixing, the third step in externally adding treatment was conducted as follows. 3 g of the magnesium stearate particles ("MM-2" manufactured by NOF Corporation; a number average particle size of 1.9 μm) and 3 g of the positively-charged silica particles ("NA50H" manufactured by Nippon Aerosil Co., Ltd.; a number average particle size of 30 nm) were added thereto, followed by subjecting to the mixing processing for 2 minutes at a peripheral velocity of the turbine blade of 60 m/s with an amount of sealing air of 1.0 $Nm^3/h$ to obtain a toner.

In addition, the difference between the work functions is 0.16.

Similarly to Example 1B, the amount of the fine particles in the toner of 3 μm or less, the uniformity of the amount of the toner to be transported, and the scratches on the surfaces of the developing roller and the latent image carrier (organic photosensitive layer) after 3,000 sheets was printed by 5% printing were observed. The result thereof is also shown in Table 11.

Comparative Example 4B

Using the cyan toner mother particles 2 prepared in the production example 5 of the toner mother particles, 3.0 kg of the cyan toner mother particles 2 were charged in the same spherical mixing tank as in Example in. Then, 15 g of the silica fine particles ("RX200" manufactured by Nippon Aerosil Co., Ltd.; a number average particle size of 12 nm) and 15 g of the silica fine particles ("RX50" manufactured by Nippon Aerosil Co., Ltd.; a number average particle size of 40 nm) were added thereto, followed by subjecting to the mixing processing for 2 minutes at a peripheral velocity of the turbine blade of 50 m/s with an amount of sealing air of 1.0 $Nm^3/h$.

After stopping the mixing, the second step in externally adding treatment was conducted as follows. 15 g of the titanium oxide fine particles ("STT-30S" manufactured by Titan Kogyo K.K.; a number average particle size of 30 nm) and 6 g of the α-type alumina 5 ("LS-250" manufactured by Nippon Light Metal Co., Ltd.; a number average particle size of 0.59 μm) were added thereto, followed by subjecting to the mixing processing for 2 minutes at a peripheral velocity of the turbine blade of 50 m/s with an amount of sealing air of 1.0 $Nm^3/h$.

After stopping the mixing, the third step in externally adding treatment was conducted as follows. 3 g of the magnesium stearate particles ("MM-2" manufactured by NOW Corporation; a number average particle size of 1.9 μm) and 3 g of the positively-charged silica particles ("NA50H" manufactured by Nippon Aerosil Co., Ltd.; a number average particle size of 30 nm) were added thereto, followed by subjecting to the mixing processing for 2 minutes at a peripheral velocity of the turbine blade of 50 m/s with an amount of sealing air of 1.0 $Nm^3/h$ to obtain a toner.

In addition, the difference between the work functions is 0.11.

Similarly to Example 1B, the amount of the fine particles in the toner of 3 μm or less, the uniformity of the amount of the toner to be transported, and the scratches on the surfaces of the developing roller and the latent image carrier (organic photosensitive layer) after 3,000 sheets was printed by 5% printing were observed. The result thereof is also shown in Table 11.

Comparative Example 5B

Using the cyan toner mother particles 2 prepared in the production example 5 of the toner mother particles, 3.0 kg of the cyan toner mother particles 2 were charged in a Henschel 20LYiA0. Then, 15 g of the silica fine particles ("RX200" manufactured by Nippon Aerosil Co., Ltd.; a number average particle size of 12 nm), 15 g of the silica fine particles ("RX50" manufactured by Nippon Aerosil Co., Ltd.; a number average particle size of 40 nm), 15 g of the titanium oxide fine particles ("STT-30S" manufactured by Titan Kogyo K.K.; a number average particle size of 30 nm), 6 g of the α-type alumina 5 ("LS-250" manufactured by Nippon Light Metal Co., Ltd.; a number average particle size of 0.59 μm), 3 g of the zinc stearate particles ("MZ2" manufactured by NOF Corporation; a number average particle size of 0.9 μm) and 3 g of the positively-charged silica particles ("NA50H" manufactured by Nippon Aerosil Co., Ltd.; a number average particle size of 30 nm) were added thereto, followed by subjecting to the mixing processing for 2 minutes at a peripheral velocity of the turbine blade of 60 m/s with an amount of sealing air of 1.0 $Nm^3/h$ to obtain a toner.

In addition, the difference between the work functions is 0.11.

Similarly to Example 1B, the amount of the fine particles in the toner of 3 μm or less, the uniformity of the amount of the toner to be transported, and the scratches on the surfaces of the developing roller and the latent image carrier (organic photosensitive layer) after 3,000 sheets was printed by 5% printing were observed. The result thereof is also shown in Table 11.

TABLE 11

| | Ratio of external additives to be freed (number %) | Uniformity of the amount of the toner to be transported | Scratches on the surface of the developing roller | Scratches on the organic photosensitive layer |
|---|---|---|---|---|
| Example 1B | 3.0 | A | A | A |
| Example 2B | 3.1 | A | A | A |
| Example 3B | 2.1 | A | A | A |
| Example 4B | 2.9 | A | A | A |
| Example 5B | 1.7 | A | A | A |
| Example 6B | 1.8 | A | A | A |
| Example 7B | 2.5 | A | A | A |
| Example 8B | 2.7 | A | A | A |
| Comparative Example 1B | 27.5 | C | B | C |

TABLE 11-continued

| | Ratio of external additives to be freed (number %) | Uniformity of the amount of the toner to be transported | Scratches on the surface of the developing roller | Scratches on the organic photosensitive layer |
|---|---|---|---|---|
| Comparative Example 2B | 45.0 | C | C | C |
| Comparative Example 3B | 30.2 | C | B | C |
| Comparative Example 4B | 29.5 | C | B | C |
| Comparative Example 5B | 48.2 | C | C | C |

As is clear from Table 11, it is known in accordance with the invention that the ratio of external additives to be freed is suppressed, the durability is excellent, the uniformity of the amount of the toner to be transported is also excellent, and the abrasion of the developing roller and the latent image carrier (organic photosensitive layer) is not generated.

As described above, in the negatively chargeable spherical toner according to the invention, since the alumina fine particle can be prevented from being freed by allowing the work function ($\Phi_t$) of the toner mother particle to be larger than the work function ($\Phi_A$) of the alumina fine particle having a large particle size, a color image can stably be outputted even after a long-term continuous printing. Particularly, when it is used in a non-contact development, the negatively chargeable spherical toner in which a scattering property of the toner is not deteriorated can be prepared. Further, since the alumina fine particle having the large particle size is not scattered, abrasion at the latent image carrier, the developing member, the restricting member and the intermediate transfer member can be reduced.

Furthermore, according to the process for producing a negatively chargeable spherical toner of the invention, a toner can be obtained, which has excellent adherence of the alumina fine particle having a large particle size with a number average particle size being from 0.1 to 1.0 μm to the toner mother particle, excels in durability, is capable of decreasing the amount of the alumina fine particles to be freed even after a long-term continuous printing, does not leave a scratch on the surface of the developing roller or the latent image carrier by suppressing the amount of the alumina fine particles, and does not give any influence on the image.

While the present invention has been described in detail and with reference to specific embodiments thereof, it will be apparent to one skilled in the art that various changes and modifications can be made therein without departing from the spirit and scope thereof.

What is claimed is:

1. A negatively chargeable spherical toner comprising:

a toner mother particle comprising a binder resin and a colorant, which has: a number average particle size of from 4.5 to 9 μm; a particle size distribution that has an integrated value of particle sizes of 3 μm or less of 1% or less; and an average sphericity of from 0.95 to 0.99; and an alumina fine particle externally added to the toner mother particle, which has a number average particle size of from 0.1 to 1.0 μm, wherein a work function ($\Phi_t$) of the toner mother particle is larger than a work function ($\Phi_A$) of the alumina fine particle by at least 0.4 eV.

2. The negatively chargeable spherical toner according to claim 1, wherein the work function ($\Phi_t$) of the toner mother particle is from 5.2 to 5.8 eV; and the work function ($\Phi_A$) of the alumina fine particle is from 4.8 to 5.3 eV.

3. The negatively chargeable spherical toner according to claim 1, wherein the alumina fine particle is an α-type alumina fine particle.

4. The negatively chargeable spherical toner according to claim 1, wherein the toner mother particle is obtained by a solution suspension method.

5. The negatively chargeable spherical toner according to claim 1, wherein the toner mother particle has the colorant on a surface of the toner mother particle.

6. The negatively chargeable spherical toner according to claim 1, which is a full-color toner.

7. A color image forming apparatus comprising:

negatively chargeable spherical toners;

a latent image carrier;

a plurality of developing units each for developing an electrostatic latent image by using the negatively chargeable spherical toners so as to form toner images sequentially on the latent image carrier;

an intermediate transfer medium to which the toner images are transferred sequentially so as to form a color toner image; and a recording material to which the color toner image is transferred and fixed, wherein each of the negatively chargeable spherical toners comprises:

a toner mother particle comprising a binder resin and a colorant, which has; a number average particle size of from 4.5 to 9 μm; a particle size distribution that has an integrated value of particle sizes of 3 μm or less of 1% or less; and an average sphericity of from 0.95 to 0.99; and an alumina fine particle externally added to the toner mother particle, which has a number average particle size of from 0.1 to 1.0 μm, wherein a work function ($\Phi_t$) of the toner mother particle is larger than a work function ($\Phi_A$) of the alumina fine particle by at least 0.4 eV.

8. The color image forming apparatus according to claim 7, wherein the developing units each develops the electrostatic latent image by a non-contact developing method.

9. The color image forming apparatus according to claim 7, wherein the developing units each develops the electrostatic latent image by a 4-cycle type rotary developing method.

10. The color image forming apparatus according to claim 7, wherein the developing units each develops the electrostatic latent image by a tandem type developing method.

11. A process for producing a negatively chargeable spherical toner, which comprises:

externally adding an alumina fine particle having a number average particle size of from 0.1 to 1.0 μm to a toner mother particle comprising a binder resin and a colorant, which has: a number average particle size of from 4.5 to 9 μm; a particle size distribution that has an integrated value of particle sizes of 3 μm or less of 1% or less; and an average sphericity of from 0.95 to 0.99 in a spherical mixing processing tank, wherein a work function ($\Phi_t$) of the toner mother particle is larger than a work function ($\Phi_A$) of the alumina fine particle by at least 0.4 eV, wherein the spherical mixing processing tank has:

a bottom having a horizontal disc-shape;

a rotary driving shaft vertically penetrating the center of the bottom;

a stirring blade which upwardly discharges materials including the alumina fine particle and the toner mother particle so that the materials are treated spirally along an inner wall of the spherical mixing processing tank; and a cylinder-shaped member vertically penetrating a top of the spherical mixing processing tank, which is on an extension of the rotary driving shaft and is arranged so that an edge thereof is located within the spherical mixing processing tank, wherein the materials which is upwardly discharged are transferred to the top of the spherical mixing processing tank spirally by a rotation of the stirring blade, and are lowered the kinetic energy threreof, and are resupplied to the stirring blade.

12. The process for producing a negatively chargeable spherical toner according to claim 11, wherein the work function ($\Phi_t$) of the toner mother particle is from 5.2 to 5.8 eV; and the work function ($\Phi_A$) of the alumina fine particle is from 4.8 to 5.3 eV.

13. The process for producing a negatively chargeable spherical toner according to claim 11, wherein the toner mother particle is obtained by a solution suspension method.

14. The process for producing a negatively chargeable spherical toner according to claim 11, wherein the toner mother particle has the colorant on a surface of the toner mother particle.

15. The process for producing a negatively chargeable spherical toner according to claim 11, which further comprising externally adding at least one of a hydrophobilized silica and a hydrophobilized titania.

16. The process for producing a negatively chargeable spherical toner according to claim 15, which further comprising externally adding, after externally adding at least one of a hydrophobilized silica and a hydrophobilized titania, a metal soap particle and a fine particle having a polarity reverse to that of the toner mother particle.

* * * * *